US012173476B2

(12) United States Patent
Koiwai et al.

(10) Patent No.: US 12,173,476 B2
(45) Date of Patent: Dec. 24, 2024

(54) HYDRAULIC WORK MACHINE

(71) Applicants: KOBELCO CONSTRUCTION MACHINERY CO., LTD., Hiroshima (JP); HIROSHIMA UNIVERSITY, Hiroshima (JP)

(72) Inventors: Kazushige Koiwai, Hiroshima (JP); Yohei Ono, Hiroshima (JP); Natsuki Yumoto, Hiroshima (JP); Shin Wakitani, Hiroshima (JP); Toru Yamamoto, Hiroshima (JP)

(73) Assignees: KOBELCO CONSTRUCTION MACHINERY CO., LTD., Hiroshima (JP); HIROSHIMA UNIVERSITY, Hiroshima (JP)

( * ) Notice: Subject to any disclaimer, the term of this patent is extended or adjusted under 35 U.S.C. 154(b) by 0 days.

(21) Appl. No.: 18/262,645

(22) PCT Filed: Dec. 21, 2021

(86) PCT No.: PCT/JP2021/047443
§ 371 (c)(1),
(2) Date: Jul. 24, 2023

(87) PCT Pub. No.: WO2022/168477
PCT Pub. Date: Aug. 11, 2022

(65) Prior Publication Data

US 2024/0110364 A1 Apr. 4, 2024

(30) Foreign Application Priority Data

Feb. 4, 2021 (JP) ..... 2021-016500

(51) Int. Cl.
*E02F 9/22* (2006.01)

(52) U.S. Cl.
CPC ..... *E02F 9/2235* (2013.01); *E02F 9/2221* (2013.01); *E02F 9/2285* (2013.01); *E02F 9/2296* (2013.01)

(58) Field of Classification Search
CPC ..... E02F 9/2221; E02F 9/2235; E02F 9/2285; E02F 9/2296
See application file for complete search history.

(56) References Cited

U.S. PATENT DOCUMENTS 6,173,573 B1 1/2001 Kamada
6,438,953 B1 8/2002 Kamada
(Continued)

FOREIGN PATENT DOCUMENTS

JP 5-195546 A 8/1993
JP 9-236101 A 9/1997
(Continued)

OTHER PUBLICATIONS

WO 2015151776 A1 machine translation (Year: 2015).*
(Continued)

*Primary Examiner* — Kenneth Bomberg
*Assistant Examiner* — Matthew Wiblin
(74) *Attorney, Agent, or Firm* — Oblon, McClelland, Maier & Neustadt, L.L.P.

(57) ABSTRACT

A pump control device and a valve control device each includes: an instruction calculator that calculates a control instruction of causing a controlled object to operate by using a manipulation amount of a manipulation and at least one control parameter, and inputs the calculated control instruction to the controlled object; and an ideal output calculator that calculates an ideal output of an actuator, the ideal output being associated with the manipulation amount of the manipulation. The pump control device adjusts at least one pump control parameter to reduce a difference between a
(Continued)

control output and the ideal output when an operation of a movable part is a power running operation. The valve control device adjusts at least one valve control parameter to reduce a difference between a control output and the ideal output when the operation of the movable part is a non-power running operation.

13 Claims, 11 Drawing Sheets

(56) References Cited

U.S. PATENT DOCUMENTS

| | | | | |
|---|---|---|---|---|
| 2015/0059568 | A1 | 3/2015 | Williamson et al. | |
| 2018/0305898 | A1 | 10/2018 | Kobayashi et al. | |
| 2021/0262191 | A1* | 8/2021 | Ito | E02F 9/2228 |
| 2022/0010522 | A1* | 1/2022 | Shiratani | E02F 9/205 |
| 2022/0170233 | A1* | 6/2022 | Ono | E02F 3/435 |

FOREIGN PATENT DOCUMENTS

| | | | | |
|---|---|---|---|---|
| JP | 11-311203 | A | 11/1999 | |
| JP | 1 553 231 | A2 | 7/2005 | |
| JP | 2012-225084 | A | 11/2012 | |
| JP | 2014-222006 | A | 11/2014 | |
| JP | 2017-110774 | A | 6/2017 | |
| JP | 2018-155066 | A | 10/2018 | |
| JP | 2019-44933 | A | 3/2019 | |
| JP | 2020-133705 | A | 8/2020 | |
| WO | WO-2015151776 | A1 * | 10/2015 | E02F 3/435 |

OTHER PUBLICATIONS

International Search Report mailed on Mar. 1, 2022 in PCT/JP2021/047443 filed on Dec. 21, 2021 (2 pages).

Extended European Search Report issued Jul. 8, 2024 in European Patent Application No. 21924862.2, 7 pages.

* cited by examiner

HYDRAULIC WORK MACHINE

TECHNICAL FIELD

The present invention relates to a hydraulic working machine including a control device that controls a controlled object.

BACKGROUND ART

An improvement in the operability of a manipulation by an operator in a hydraulic working machine, such as a hydraulic excavator, leads to an improvement in a work efficiency on a worksite.

For instance, Patent Literature 1 discloses a hydraulic actuator control device including an electric current controller. The hydraulic actuator control device supplies, to a solenoid proportional flow rate control valve, an electric current larger than a target electric current corresponding to a manipulation amount of a manipulation lever for only a predetermined short time period at a start of a driving manipulation from a neutral position with an aim of improving the operability by reducing response delay in activating the hydraulic actuator from a suspension state.

Patent Literature 2 discloses a construction machine including a controller that outputs a command current for driving a solenoid proportional valve in response to a manipulation signal from a manipulation device. The controller has a correction function to correct the command current in such a manner that the command current is higher than a target current corresponding to a manipulation amount of a manipulation device for a preset predetermined time at a time of starting to manipulate the manipulation device from a neutral position thereof with an aim of ensuring an initial response that varies in accordance with a type of hydraulic actuator.

Patent Literature 3 discloses a hydraulic working machine including a control device to improve initial responsiveness of a hydraulic actuator while ensuring energy saving performance. The control device modifies a pump target flow rate by adding a predetermined modification flow rate, which is larger than a pump minimum flow rate of a first hydraulic pump, to a pump target flow rate for a period to a lapse of a predetermined modification time after a manipulation of a first manipulation lever from a neutral position thereof.

Patent Literature 4 discloses a construction machine including a controller for keeping a specific relationship regardless of a change in a reach, the specific relationship being a relationship between a boom manipulation amount and a rising or lowering amount of an attachment leading end in a rising or lowering operation of the attachment leading end to rise or to be lowered. In a boom raising manipulation in a loading direction, the controller modifies, in accordance with the reach, a pump flow rate determined by a boom raising manipulation amount, specifically, the controller decreases the pump flow rate when the reach is long and increases the pump flow rate when the reach is short. By contrast, in the boom lowering operation in which the own weight of the attachment acts, a secondary pressure of a proportional valve provided on a boom lowering pilot line is modified in accordance with the reach to thereby reduce an opening degree of a control valve when the reach is long and increase the opening degree when the reach is short.

Meanwhile, input and output characteristics of a controlled object including: a proportional valve that receives an input of an instruction from a control device; and an actuator that causes a movable part, such as a boom, to operate may largely fluctuate due to, for example, replacement of a leading end attachment, an aging deterioration of a component of a working machine, or other factor. In this regard, the controller or control device disclosed in each of Patent Literatures 1 to 4 does not consider such a fluctuation in the input and output characteristics of the controlled object. A control output being an output of the actuator thus fails to be suited to a manipulation amount in a case of a large fluctuation in the input and output characteristics of the controlled object. Further, a controlled object to be targeted in a power running operation like a boom rising operation differs from a controlled object to be targeted in a non-power running operation like a boom lowering operation. A rate of the aging deterioration varies depending on each component constituting the corresponding controlled object. Under the circumstances, each of the power running operation and the non-power running operation of the movable part is required to approximate to an ideal operation suited to the manipulation amount even in a case of a large fluctuation in the input and output characteristics of the controlled object.

CITATION LIST

Patent Literatures

Patent Literature 1: Japanese Unexamined Patent Publication No HEI 5-195546

Patent Literature 2: Japanese Unexamined Patent Publication No. 2017-110774

Patent Literature 3: Japanese Unexamined Patent Publication No. 2019-44933

Patent Literature 4: Japanese Unexamined Patent Publication No. 2012-225084

SUMMARY OF INVENTION

The present invention has been achieved to solve the aforementioned drawbacks with an aim of providing a hydraulic working machine that allows each of a power running operation and a non-power running operation to approximate to an ideal operation suited to a manipulation amount even in a case of a large fluctuation in input and output characteristics of a controlled object.

A hydraulic working machine according to one aspect of the present invention includes: a support body; a movable part that is shiftable relative to the support body; a hydraulic pump that discharges hydraulic fluid; an actuator that receives a supply of the hydraulic fluid to cause the movable part to operate; a control valve that is located between the hydraulic pump and the actuator, and opens and closes to change a flow rate of the hydraulic fluid to be supplied to the actuator; a manipulation device that receives a manipulation for an operation of the movable part; an operation determinator that determines whether the operation of the movable part performed in response to the manipulation received by the manipulation device is a power running operation of the movable part to operate against a load acting on the movable part or a non-power running operation of the movable part to operate in a direction of the load acting on the movable part; a pump control device that regulates a discharge rate of the hydraulic pump; a valve control device that regulates an opening degree of the control valve; and an output detector that detects a control output being an output of the actuator. The pump control device has: a pump instruction calculator that calculates, by using a manipulation amount of the manipulation and at least one pump control parameter, a control instruction of causing a controlled object including the hydraulic pump and the actuator to operate, and inputs the calculated control instruction to the controlled object; a pump control ideal output calculator that calculates an ideal output of the actuator, the ideal output being associated with the manipulation amount of the manipulation; and a pump control parameter adjuster that adjusts the at least one pump control parameter to reduce a difference between the control output and the ideal output when the operation of the movable part is the power running operation. The valve control device has: a valve instruction calculator that calculates, by using the manipulation amount of the manipulation and at least one valve control parameter, a control instruction of causing a controlled object including the control valve and the actuator to operate, and inputs the calculated control instruction to the controlled object; a valve control ideal output calculator that calculates an ideal output of the actuator, the ideal output being associated with the manipulation amount of the manipulation; and a valve control parameter adjuster that adjusts the at least one valve control parameter to reduce a difference between the control output and the ideal output when the operation of the movable part is the non-power running operation.

DESCRIPTION OF EMBODIMENTS

Figure 1:
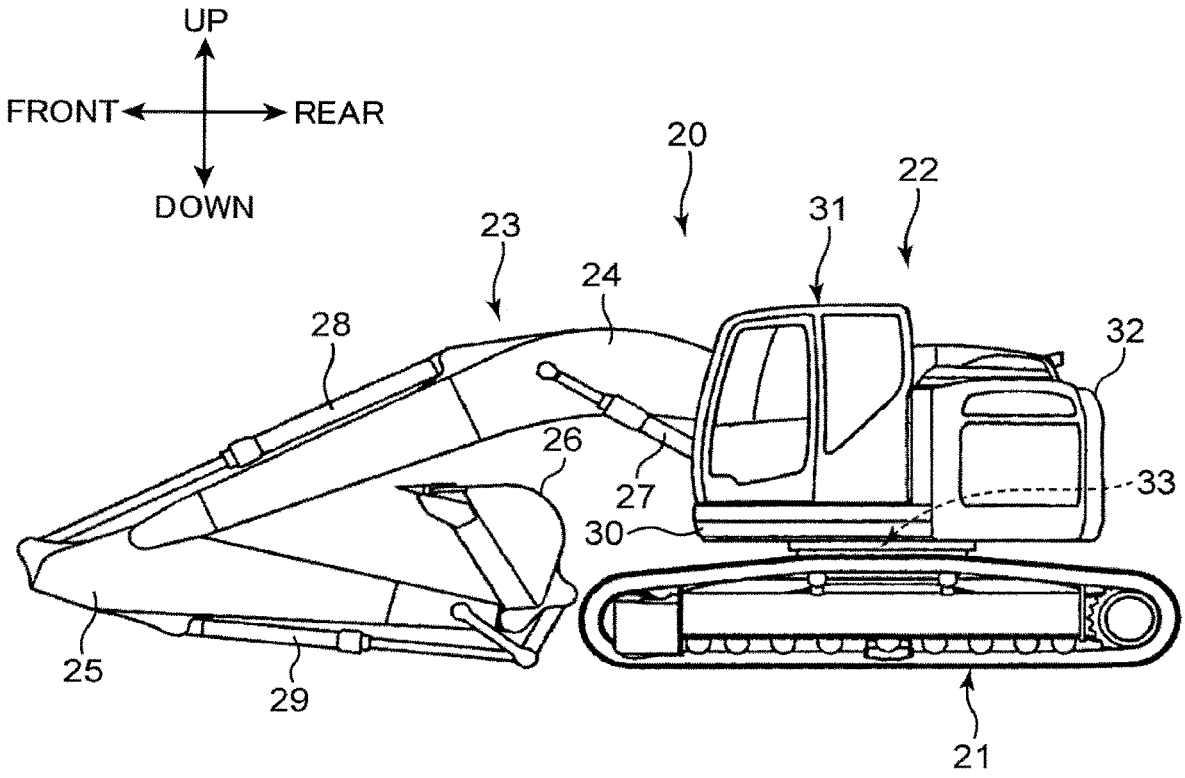
FIG. 1 is a side view of an example of a hydraulic working machine according to an embodiment of the present invention.
Figure 2:
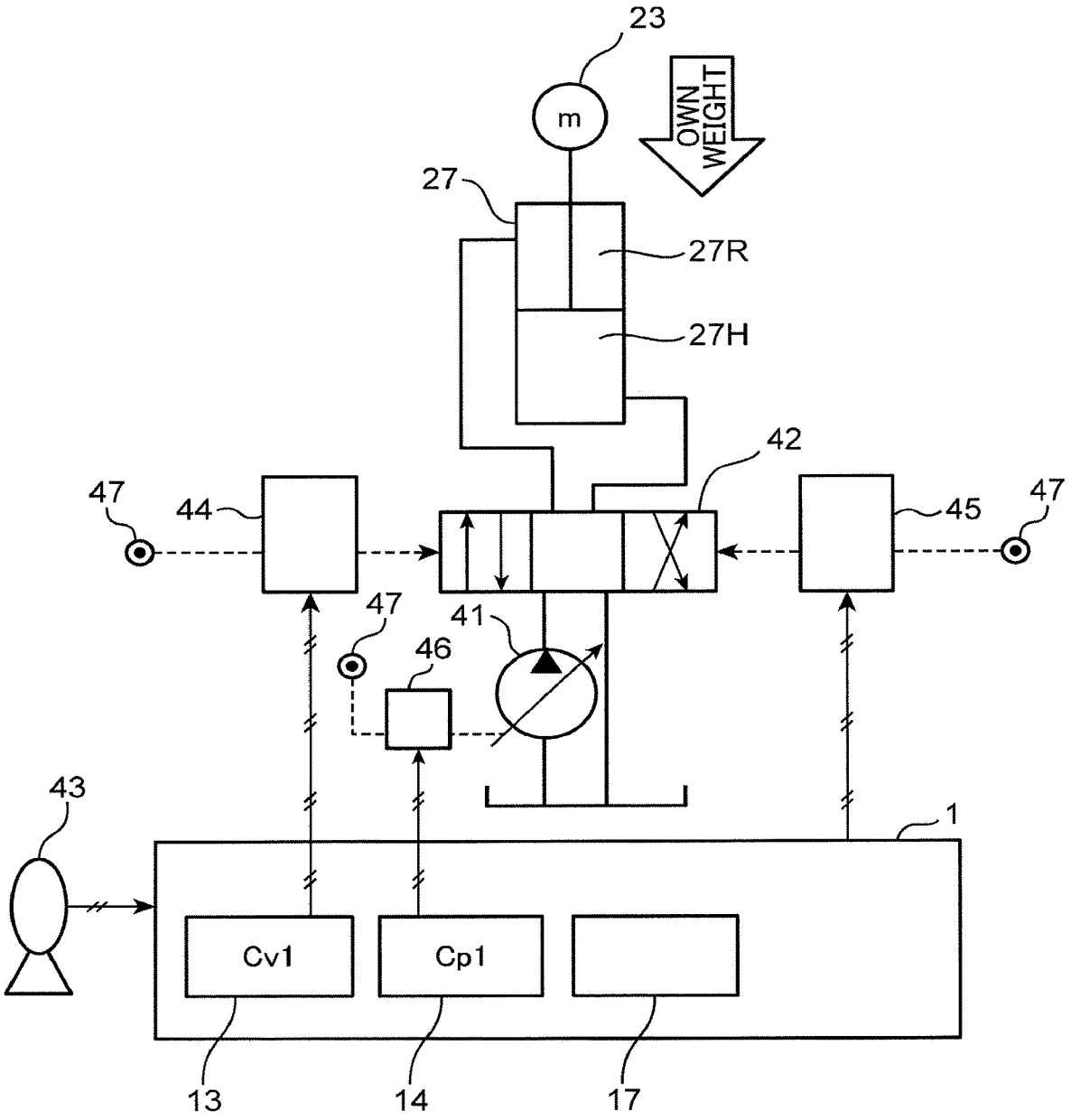
FIG. 2 is a diagram showing an example of a hydraulic circuit and a control unit included in the hydraulic working machine.

Hereinafter, an embodiment of the present invention will be described with reference to the accompanying drawings. FIG. 1 is a side view of a hydraulic excavator 20 which is an example of a hydraulic working machine according to an embodiment. FIG. 2 is a diagram showing an example of a hydraulic circuit and a control unit included in the hydraulic excavator 20.

As shown in FIG. 1 and FIG. 2, the hydraulic excavator 20 includes: a lower traveling body 21 of a self-running type; an upper slewing body 22 slewably supported on the lower traveling body 21; a working device 23; a plurality of hydraulic actuators; a plurality of hydraulic pumps; a pilot pump 47; a plurality of control valves; a plurality of manipulation devices; a plurality of proportional valves; an output detector 12 (see FIG. 3); and a control unit 1.

The upper slewing body 22 includes an upper frame 30 slewably supported on the lower traveling body 21, a cabin 31 supported on the upper frame 30, and a counterweight 32 disposed in the rear of the cabin 31. The lower traveling body 21 and the upper slewing body 22 serve as an example of a support body.

The working device 23 includes a boom 24 tiltably supported on the upper frame 30, an arm 25 rotatably supported on a distal end of the boom 24, and a bucket 26 rotatably supported on a distal end of the arm 25. The boom 24 serves as an example of the movable part.

The hydraulic actuators include a boom cylinder 27, an arm cylinder 28, a bucket cylinder 29, and a slewing motor 33.

Each of the hydraulic pumps is a hydraulic pump for supplying hydraulic fluid to at least one of the hydraulic actuators. The hydraulic pumps include a hydraulic pump 41 of a variable displacement type shown in FIG. 2. The pilot pump 47 is a hydraulic pump for supplying a pilot pressure to each of the control valves. Each of the hydraulic pumps and the pilot pump 47 is driven by an unillustrated engine.

FIG. 2 representatively shows a circuit of causing the boom cylinder 27 to operate without illustrations of circuits of respectively causing the arm cylinder 28, the bucket cylinder 29, and the slewing motor 33 to operate. Each of the circuits of respectively causing the arm cylinder 28, the bucket cylinder 29, and the slewing motor 33 to operate has the same structure as the circuit of causing the boom cylinder 27 shown in FIG. 2 to operate.

The boom cylinder 27 is a hydraulic cylinder that receives a supply of the hydraulic fluid from the hydraulic pump 41 shown in FIG. 2 to cause the boom 24 to perform a rising or lowering operation. As illustrated in FIG. 1, the boom cylinder 27 includes a cylinder tube having a proximal end rotatably attached to the upper frame 30 of the upper slewing body 22, and the boom cylinder 27 includes a piston rod having a distal end rotatably attached to the boom 24. As shown in FIG. 2, the boom cylinder 27 has a rod chamber 27R and a head chamber 27H.

The arm cylinder 28 is a hydraulic cylinder that receives a supply of the hydraulic fluid from any one of the hydraulic pumps to cause the arm 25 to rotate. The bucket cylinder 29 is a hydraulic cylinder that receives a supply of the hydraulic fluid from any one of the hydraulic pumps to cause the bucket 26 to rotate. The slewing motor 33 is a hydraulic motor that receives a supply of the hydraulic fluid from any one of the hydraulic pumps to cause the upper frame 30 of the upper slewing body 22 to slew to the lower traveling body 21.

The control valves include a boom control valve 42 shown in FIG. 2, an unillustrated arm control valve, an unillustrated bucket control valve, and an unillustrated slewing control valve. Each of the control valves has a spool and a pair of pilot ports for receiving the pilot pressure from the pilot pump 47.

The boom control valve 42 is located between the hydraulic pump 41 and the boom cylinder 27, and opens and closes to change a direction and a flow rate of the hydraulic fluid to be supplied to the boom cylinder 27. The arm control valve is located between any one of the hydraulic pumps and the arm cylinder 28, and opens and closes to change a direction and a flow rate of the hydraulic fluid to be supplied to the arm cylinder 28. The bucket control valve is located between any one of the hydraulic pumps and the bucket cylinder 29, and opens and closes to change a direction and a flow rate of the hydraulic fluid to be supplied to the bucket cylinder 29. The slewing control valve is located between any one of the hydraulic pumps and the slewing motor 33, and opens and closes to change a direction and a flow rate of the hydraulic fluid to be supplied to the slewing motor 33.

The manipulation devices include a boom manipulation device 43 (see FIG. 2) that receives a manipulation for an operation of the boom 24, an unillustrated arm manipulation device that receives a manipulation for an operation of the arm 25, an unillustrated bucket manipulation device that receives a manipulation for an operation of the bucket 26, and an unillustrated slewing manipulation device for a slewing operation of the upper slewing body 22 to the lower traveling body 21. Each of the manipulation devices has a manipulation lever for allowing an operator to give a manipulation thereto. Each of the manipulation devices represents an electric lever device that outputs an instruction signal (electric signal) corresponding to a manipulation received by the manipulation lever and a manipulation amount thereof. The output instruction signal is input to the control unit 1.

Specifically, the boom manipulation device 43 is configured to receive a boom raising manipulation for causing the boom 24 to perform a boom rising operation and a boom lowering manipulation for causing the boom 24 to perform a boom lowering operation. The boom rising operation is an operation of the boom 24 that the distal end of the boom 24 rises away from the ground, and the boom lowering operation is an operation of the boom 24 that the distal end of the boom 24 approaches the ground. The boom rising operation requires a regulation of a discharge rate of the hydraulic pump 41 to shift the working device 23 in a direction opposite to a direction of the gravity as shown in FIG. 2. The boom rising operation serves as an example of a power running operation of the boom 24 to operate against a load acting on the working device 23 including the boom 24. The boom lowering operation requires a regulation of an opening degree of the boom control valve 42 to shift the working device 23 in the direction of the gravity acting on the working device 23 at a desired operation speed. The boom lowering operation serves as an example of a non-power running operation of the boom 24 to operate in a direction of the load acting on the working device 23 including the boom 24. The boom raising manipulation serves as an example of an power running manipulation, and the boom lowering manipulation serves as an example of a non-power running manipulation (regenerative manipulation).

When the boom manipulation device 43 receives the boom raising manipulation, the boom manipulation device inputs, to the control unit 1, a boom raising instruction signal corresponding to the boom raising manipulation and a manipulation amount thereof. When the boom manipulation device 43 receives the boom lowering manipulation, the boom manipulation device inputs, to the control unit 1, a boom lowering instruction signal corresponding to the boom lowering manipulation and a manipulation amount thereof. The basic configuration and function of each of the arm manipulation device, the bucket manipulation device, and the slewing manipulation device are the same as those of the boom manipulation device 43, and thus detailed description therefor is omitted.

Each of the proportional valves reduces a pressure of the hydraulic fluid from the pilot pump 47 and outputs the hydraulic fluid having the reduced pressure in response to a control instruction input from the control unit 1. Each of the proportional valves is formed of, for example, a solenoid proportional valve. The proportional valves include a pair of boom proportional valves 44, 45, a pair of arm proportional valves (not shown), a pair of bucket proportional valves (not shown), and a pair of slewing proportional valves (not shown), and a pump proportional valve 46.

Specifically, each of the two boom proportional valves 44, 45 reduces a pressure of the hydraulic fluid from the pilot pump 47 in response to a control instruction (instruction electric current) input from the control unit 1, and outputs a pilot pressure responsive to the control instruction to the boom control valve 42. The pair of boom proportional valves 44, 45 is provided on a pair of pilot lines connecting the pilot pump 47 and the pair of pilot ports of the boom control valve 42 to each other.

When the boom manipulation device 43 receives the boom lowering manipulation, a control instruction is input from the control unit 1 to the boom proportional valve 44. The boom proportional valve 44 generates a pilot pressure responsive to the control instruction, and the generated pilot pressure is supplied to one of the pilot ports of the boom control valve 42, i.e., the left port of the boom control valve 42 in FIG. 2. The spool of the boom control valve 42 shifts in a shift amount (which is a shift amount from a neutral position) corresponding to the supplied pilot pressure. In this manner, the boom control valve 42 has an opening degree (opening amount) regulated to correspond to the shift amount so as to permit the hydraulic fluid discharged from the hydraulic pump 41 to be supplied to the rod chamber 27R of the boom cylinder 27 at a flow rate corresponding to the shift amount, and permit the hydraulic fluid to be discharged from the head chamber 27H and return to the tank.

When the boom manipulation device 43 receives the boom raising manipulation, a control instruction is input from the control unit 1 to the boom proportional valve 45. The control unit 1 outputs, as the control instruction, an instructive value in accordance with a manipulation amount of the boom raising manipulation. The boom proportional valve 45 generates a pilot pressure responsive to the control instruction, and the generated pilot pressure is supplied to the other of the pilot ports of the boom control valve 42, i.e., the right port of the boom control valve 42 in FIG. 2. The spool of the boom control valve 42 shifts in a shift amount (which is a shift amount from a neutral position) corresponding to the supplied pilot pressure. In this manner, the boom control valve 42 has an opening degree (opening amount) regulated to correspond to the shift amount so as to permit the hydraulic fluid discharged from the hydraulic pump 41 to be supplied to the head chamber 27H of the boom cylinder 27 at a flow rate corresponding to the shift amount, and permit the hydraulic fluid to be discharged from the rod chamber 27R and return to the tank.

Each of the two arm proportional valves reduces a pressure of the hydraulic fluid from the pilot pump 47 in response to a control instruction input from the control unit 1, and outputs a pilot pressure responsive to the control instruction to the arm control valve. Each of the two bucket proportional valves reduces a pressure of the hydraulic fluid from the pilot pump 47 in response to a control instruction input from the control unit 1, and outputs a pilot pressure responsive to the control instruction to the bucket control valve. Each of the two slewing proportional valves reduces a pressure of the hydraulic fluid from the pilot pump 47 in response to a control instruction input from the control unit 1, and outputs a pilot pressure responsive to the control instruction to the slewing control valve. The basic configuration and function of the proportional valves are the same as those of the boom proportional valves 44, 45, and thus detailed description therefor is omitted.

The pump proportional valve 46 reduces a pressure of the hydraulic fluid from a specific hydraulic pump, e.g., the pilot pump 47, in response to a control instruction (instruction electric current) output from the control unit 1, and outputs an operation pressure responsive to the control instruction to the hydraulic pump 41. The pump proportional valve 46 is provided on a pump line connecting the pilot pump 47 and the hydraulic pump 41 to each other. When the operation pressure is input to the hydraulic pump 41, a capacity (tilt angle) of the hydraulic pump 41 is adjusted to a capacity (tilt angle) corresponding to the operation pressure. In this manner, the discharge rate of the hydraulic pump 41 is regulated.

The control unit 1 includes a pump control device 14 that regulates a discharge rate of the hydraulic pump 41, a valve control device 13 that regulates an opening degree of the boom control valve 42, and an operation determinator 17 that determines an operation of the boom 24.

Figure 3:
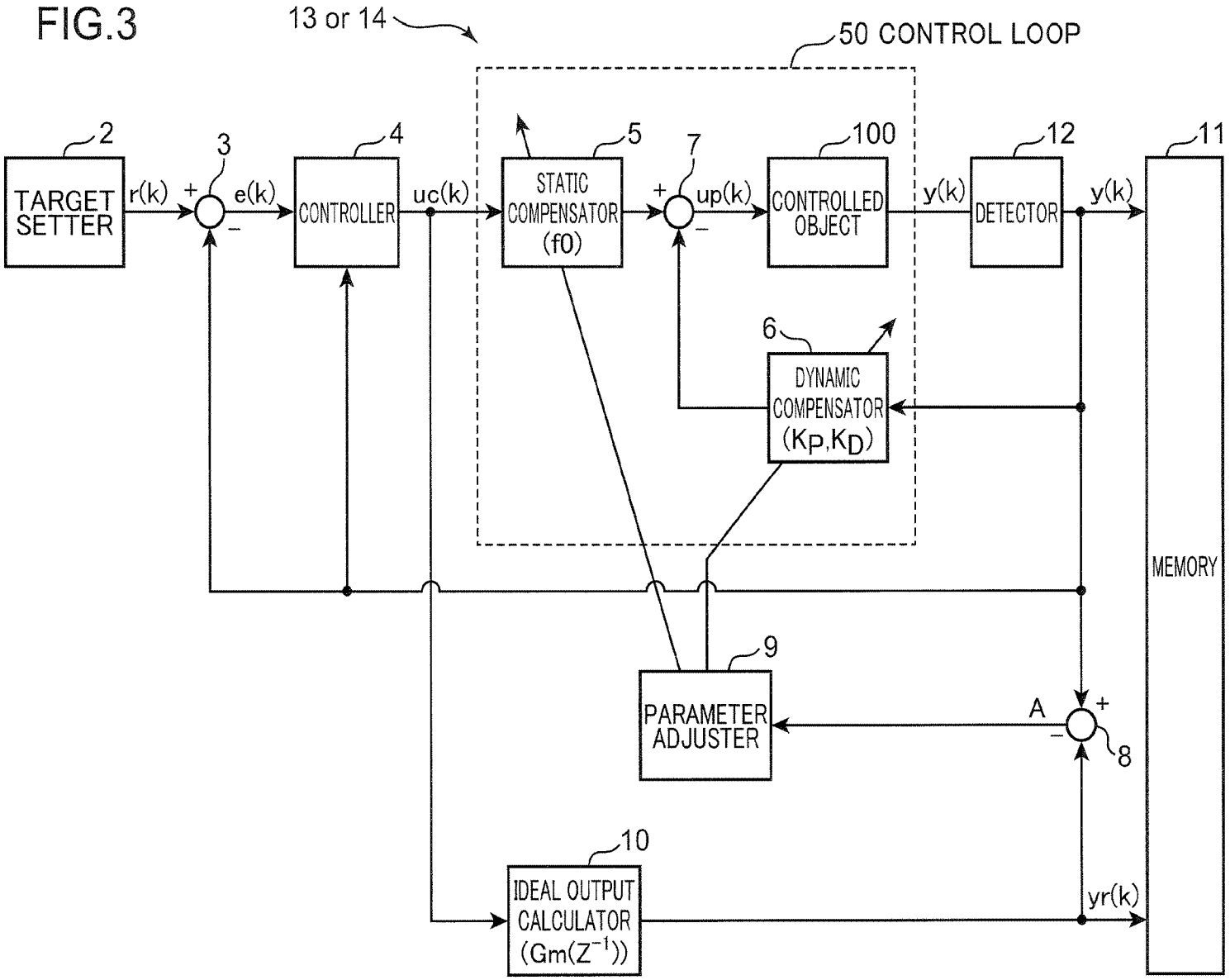
FIG. 3 is a block diagram showing an example of a control device included in the control unit.

FIG. 3 is a block diagram showing an example of a control device included in the control unit 1. The control device shown in FIG. 3 represents a configuration of each of the pump control device 14 and the valve control device 13.

The output detector 12 shown in FIG. 3 detects a control output y(k) being an output of the boom cylinder 27. The control output y(k) of the boom cylinder 27 may include, for example, an operation speed of the boom cylinder 27 or a physical quantity corresponding to the operation speed of the boom cylinder 27. The physical quantity corresponding to the operation speed may be, for example, a flow rate of the hydraulic fluid being supplied to the boom cylinder 27, may be a flow rate of the hydraulic fluid being discharged from the boom cylinder 27, or may be an operation speed of the boom 24 in a rising or lowering operation of the boom 24. In this respect, the output detector 12 may include a speed sensor for detecting the operation speed of the boom cylinder 27, a flow rate sensor for detecting the flow rate of the hydraulic fluid being supplied to the boom cylinder 27 or the flow rate of the hydraulic fluid being discharged from the boom cylinder 27, or a speed sensor for detecting the operation speed of the boom 24 in the rising or lowering operation of the boom 24.

The operation determinator 17 shown in FIG. 2 determines whether an operation of the boom 24 performed in response to a manipulation received by the boom manipulation device 43 is the boom rising operation or the boom lowering operation. When the boom manipulation device 43 receives a boom raising manipulation, the boom raising instruction signal is input to the control unit 1 and the operation determinator 17 determines that the operation of the boom 24 is the boom rising operation (power running operation). When the boom manipulation device 43 receives a boom lowering manipulation, the boom lowering instruction signal is input to the control unit 1 and the operation determinator 17 determines that the operation of the boom 24 is the boom lowering operation (non-power running operation).

As shown in FIG. 3, each of the pump control device 14 and the valve control device 13 controls a controlled object 100 that outputs a control output y(k) in response to an actual input $u_p(k)$ serving as a control instruction. In the embodiment, the controlled object 100 to be controlled by the pump control device 14 includes the pump proportional valve 46, the pump 41, and the boom cylinder 27, and the controlled object 100 to be controlled by the valve control device 13 includes the boom proportional valve 44, the boom control valve 42, and the boom cylinder 27. The sign "k" enclosed in parentheses indicates a time.

The block diagram in FIG. 3 shows the configuration of the valve control device 13 as well as the configuration of the pump control device 14. In the embodiment, the pump control device 14 and valve control device 13 basically have the same configuration except for specific values, such as their parameters to be described later.

As shown in FIG. 3, each of the pump control device 14 and the valve control device 13 has a target setter 2, a subtractor 3, a controller 4, a static compensator 5, a dynamic compensator 6, a subtractor 7 which serves as an example of the synthesizer, a parameter adjuster 9, a subtractor 8, an ideal output calculator 10, and a memory 11. The target setter 2, the subtractor 3, the controller 4, the static compensator 5, the dynamic compensator 6, the subtractor 7, the subtractor 8, the parameter adjuster 9, and the ideal output calculator 10 includes a processor, e.g., a CPU or an ASIC. The static compensator 5, the dynamic compensator 6, and the subtractor 7 serve as an example of a control input compensator. The target setter 2, the subtractor 3, the controller 4, the static compensator 5, the dynamic compensator 6, and the subtractor 7 serve as an example of an instruction calculator. The instruction calculator of the pump control device 14 serves as an example of a pump instruction calculator, and the instruction calculator of the valve control device 13 serves as an example of a valve instruction calculator. The parameter adjuster 9 of the pump control device 14 serves as an example of a pump control parameter adjuster, and the parameter adjuster 9 of the valve control device 13 serves as an example of a valve control parameter adjuster. The ideal output calculator 10 of the pump control device 14 serves as an example of a pump control ideal output calculator, and the ideal output calculator 10 of the valve control device 13 serves as an example of a valve control ideal output calculator.

The target setter 2 sets a target output r(k) in accordance with the manipulation amount of the manipulation received by the boom manipulation device 43, the target output r(k) serving as a target of the control output y(k). Specifically, the target setter 2 in the pump control device 14 sets a target output r(k) in accordance with a manipulation amount of a boom raising manipulation on the basis of, for example, a preset map showing a relationship between the manipulation amount of the boom raising manipulation and the target output r(k). The target setter 2 in the valve control device 13 sets a target output r(k) in accordance with a manipulation amount of a boom lowering manipulation on the basis of, for example, a preset map showing a relationship between the manipulation amount of the boom lowering manipulation and the target output r(k).

The subtractor 3 calculates an error e(k) by subtracting the control output y(k) from the target output r(k).

The controller 4 (control input calculator) calculates, on the basis of the control output y(k), a control input $u_c(k)$ to eliminate the error e(k). The controller 4 corresponds to an upstream controller. Each of the pump control device 14 and the valve control device 13 has a multi-staged control structure to activate a downstream control loop 50 that directly controls the controlled object 100 in accordance with an instruction from the controller 4 being the upstream controller. The control loop 50 will be described in detail later.

The controller 4 may be configured to calculate a control input $u_c(k)$ to eliminate the error e(k) under, for example, a PID control. Examples of a formula to be used for the PID control include Equation (17) which will be described later. The controller 4 may calculate the control input $u_c(k)$ by using one of various feedback controls including a P control, a PD control, and a PI control in place of the PID control, or a feedforward control.

The static compensator 5 calculates a static compensatory input for compensating a fluctuation in static characteristics of the controlled object 100 by multiplying the control input $u_c(k)$ by a static gain $f_0$ (which is an example of a static parameter). The static characteristics mean time independent characteristics of the controlled object 100. The static characteristics correspond to, for example, a scale available to the control output y(k). The static gain $f_0$ is a gain for compensating the fluctuation in the static characteristics. For instance, the actual input $u_p(k)$ excessively reduces as a dynamic compensatory input calculated by the dynamic compensator 6 excessively increases, and thus, a value of the control output y(k) decreases more largely than an estimated scale. To avoid this situation, the static compensator 5 multiplies the control input $u_c(k)$ by the static gain $f_0$.

The dynamic compensator 6 calculates, on the basis of a dynamic gain (which is an example of a dynamic parameter) and the control output y(k), a dynamic compensatory input for compensating a fluctuation in dynamic characteristics of the controlled object 100. The dynamic characteristics mean time dependent characteristics of the controlled object 100, e.g., rise characteristics and damping characteristics of the controlled object 100. The dynamic gain is a gain for compensating the fluctuation in the dynamic characteristics. The dynamic gain includes, for example, a proportional gain $K_p$ and a derivative gain $K_D$. The dynamic compensator 6 calculates the dynamic compensatory input with, for example, an arithmetic expression of "$K_p \cdot y(k)+K_D \cdot \Delta y(k)$". Here, the sign "$\Delta y(k)$" denotes a differential of y(k).

The static gain $f_0$ is initially set and the dynamic gain (proportional gain $K_p$ and derivative gain $K_D$) is initially set in each of the pump control device 14 and the valve control device 13, individually. Thus, the static gain $f_0$ initially set in the pump control device 14 may differ from the static gain $f_0$ initially set in the valve control device 13, and the dynamic gain initially set in the pump control device 14 may differ from the dynamic gain initially set in the valve control device 13. Each of the static gain $f_0$ and the dynamic gain set in the pump control device 14 serves as an example of a pump control parameter. Each of the static gain $f_0$ and the dynamic gain set in the valve control device 13 serves as an example of a valve control parameter.

The subtractor 7 calculates an actual input $u_p(K)$ as a control instruction by subtracting the dynamic compensatory input from the static compensatory input, and inputs the actual input $u_p(k)$ to the controlled object 100. In this way, the control input $u_c(k)$ is adjusted to compensate the dynamic characteristics and the static characteristics of the controlled object 100. Specifically, the subtractor 7 in the pump control device 14 inputs the calculated actual input $u_p(k)$ to the pump proportional valve 46 of the controlled object 100 (see FIG. 2). The subtractor 7 in the valve control device 13 inputs the calculated actual input $u_p(k)$ to the boom proportional valve 44 of the controlled object 100 (see FIG. 2). The actual input $u_p(k)$ is expressed by, for example, the following equation.

$$u_p(k)=f_0 \cdot u_c(k)-K_p \cdot y(k)-K_D \cdot \Delta y(k)$$

The static compensator 5, the dynamic compensator 6, the subtractor 7, and the controlled object 100 constitute the control loop 50. The control loop 50 represents a downstream control loop that directly controls the controlled object 100. The control loop 50 outputs a control output y(k) in response to the control input $u_c(k)$.

The ideal output calculator 10 calculates an ideal output $y_r(k)$ corresponding to the control input $u_c(k)$ by using an input and output model $G_m(z^{-1})$ which is a transfer function indicating an ideal input and output relationship between the control input $u_c(k)$ and the control output y(k). The ideal input and output relationship represents a relationship between the control input $u_c(k)$ and the control output y(k) at the time of designing the controller 4. Hereinafter, the relationship between the control input $u_c(k)$ and the control output y(k) is referred to as input and output characteristics of the control loop 50. For instance, in a case where the controller 4 is designed on the basis of initial input and output characteristics of the control loop 50 including the initial controlled object 100, an input and output model has initial input and output characteristics of the control loop 50. Therefore, the ideal output calculator 10 can calculate an ideal output $y_r(k)$ in accordance with the initial input and output characteristics of the control loop 50, even when the input and output characteristics of the controlled object 100 change from the initial characteristics, and the input and output characteristics of the control loop 50 change from the initial input and output characteristics. The input and output model $G_m(z^{-1})$ is expressed by, for example, Equations (19), (20), (21) to be described later.

The subtractor 8 calculates a difference A by subtracting the ideal output $y_r(k)$ from the control output y(k), and inputs the difference A to the parameter adjuster 9.

The parameter adjuster 9 adjusts each of the static gain $f_0$ and the dynamic gain ($K_p$, $K_D$) to minimize the difference A input from the subtractor 8. The parameter adjuster 9 may calculate the static gain $f_0$ and the dynamic gain ($K_p$, $K_D$) by, for example, iterative least square technique. In this case, the static gain $f_0$ and the dynamic gain ($K_p$, $K_D$) are adjusted in synchronization with a sampling time of each of the control devices 13, 14. Specifically, the static gain $f_0$ and the dynamic gain ($K_p$, $K_D$) are adjustable online. One adoptable way using the iterative least square technique is to minimize an evaluation function J shown in Equation (9), which will be described later, by using Equations (10) to (16).

The memory 11 includes, for example, a RAM or a flush memory. The memory 11 stores the control output y(k) and the ideal output $y_r(k)$. The memory 11 may store control outputs y(k) and ideal outputs $y_r(k)$ calculated in a period from a time k to a couple of previous sample points.

Figure 4:
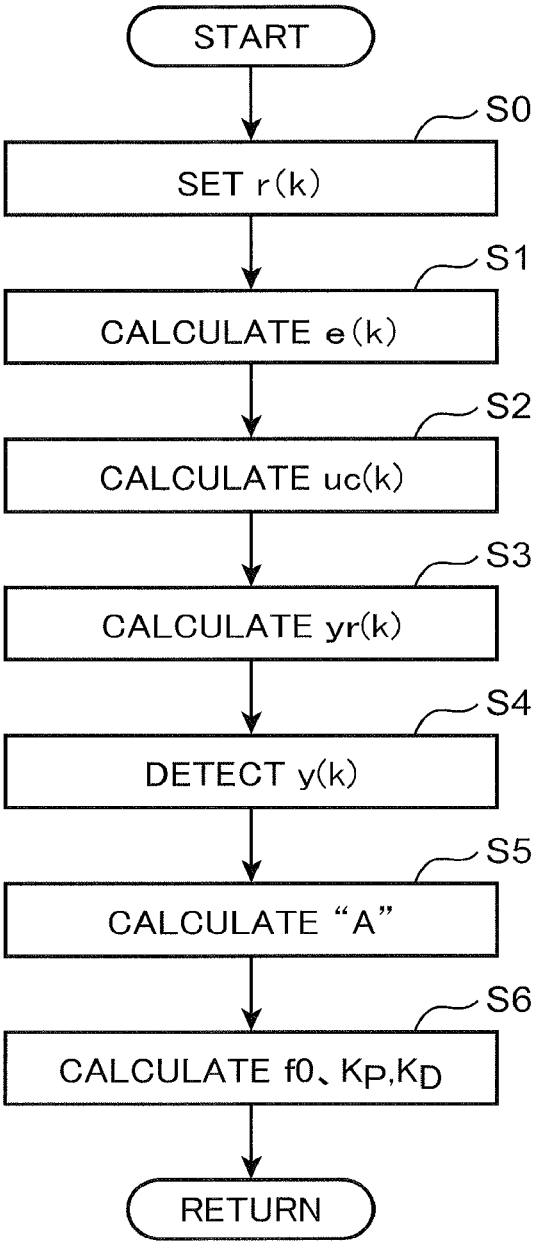
FIG. 4 is a flowchart showing an example of a process by the control device.

Next, a process by each of the control devices 13, 14 will be described. FIG. 4 is a flowchart showing an example of the process by each of the control devices 13, 14.

When the boom manipulation device 43 receives a boom raising manipulation, the boom manipulation device inputs, to the control unit 1, a boom raising instruction signal corresponding to the boom raising manipulation and a manipulation amount thereof. In step S0, the target setter 2 in the pump control device 14 sets, on the basis of the preset map, a target output r(k) in accordance with the manipulation amount of the boom raising manipulation. Similarly, when the boom manipulation device 43 receives a boom lowering manipulation, the boom manipulation device inputs, to the control unit 1, a boom lowering instruction signal corresponding to the boom lowering manipulation and a manipulation amount thereof. In step S0, the target setter 2 in the valve control device 13 sets, on the basis of the preset map, a target output r(k) in accordance with the manipulation amount of the boom lowering manipulation.

In step S1, the subtractor 3 calculates an error e(k) by subtracting the control output y(k) from the target output r(k).

In step S2, the controller 4 calculates a control input $u_c(k)$ by inputting the error e(k) and the control output y(k) to Equation (17).

In step S3, the ideal output calculator 10 calculates an ideal output $y_r(k)$ by multiplying the control input $u_c(k)$ by an input and output model $G_m(z^{-1})$ expressed by Equation (19).

In step S4, the detector 12 detects a control output y(k) which is output from the control loop 50 in response to the control input $u_c(k)$.

In step S5, the subtractor 8 calculates a difference A by subtracting the ideal output $y_r(k)$ from the control output y(k) detected by the detector 12.

In step S6, the parameter adjuster 9 calculates a static gain $f_0$ and a dynamic gain ($K_p$, $K_D$) by using the iterative least square technique to minimize the difference A. When step S6 is finished, the process returns to step S1. In this way, the static gain $f_0$ and the dynamic gain ($K_p$, $K_D$) are adjusted one after another.

As described heretofore, in the hydraulic excavator 20, the ideal output $y_r(k)$ corresponding to the control input $u_c(k)$ is calculated by using the input and output model $G_m(z^{-1})$ indicating ideal input and output characteristics of the control input $u_c(k)$ and the control output y(k), and the static gain $f_0$ belonging to the static compensator 5 and the dynamic gain ($K_p$, $K_D$) belonging to the dynamic compensator 6 is adjusted to minimize the difference A between the ideal output $y_r(k)$ and the control output y(k). In this manner, even when the input and output characteristics of the controlled object 100 largely fluctuate, the input and output characteristics of the control input $u_c(k)$ and the control output y(k) are maintained to ideal input and output characteristics at the time of designing the controller 4. Hence, even when the input and output characteristics of the controlled object 100 largely fluctuate, the controlled object 100 is appropriately controllable by using the controller 4 in the initial design. This consequently achieves simplification of the design of the controller 4 and facilitates development of the hydraulic excavator 20.

Figure 5:
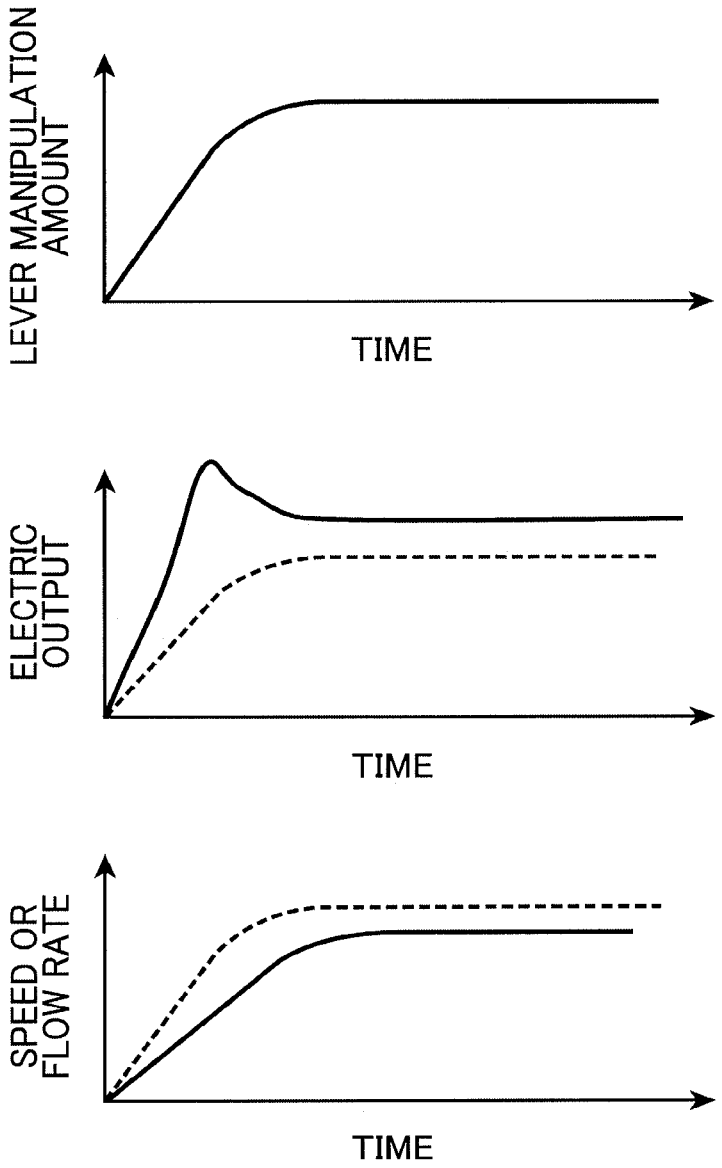
FIG. 5 includes graphs respectively showing an example of a relationship between a time and a manipulation amount of a manipulation received by a manipulation device included in the hydraulic working machine, an example of a relationship between a time and an electric output, and an example of a relationship between a time and a control output.

The upper graph in FIG. 5 exemplifies a relationship between a time and a manipulation amount (lever manipulation amount) of a boom manipulation received by the boom manipulation device 43. The middle graph in FIG. 5 exemplifies a relationship between a time and an electric output which is output from the subtractor 7 when the boom manipulation device 43 receives the boom manipulation (boom raising manipulation or boom lowering manipulation) as shown in the upper graph. The electric output which is output from the subtractor 7 represents an actual input $u_p(k)$ serving as a control instruction input from the subtractor 7 to the pump proportional valve 46 or the boom proportional valve 44 in the controlled object 100. The middle graph shows an effect of compensating a fluctuation in static characteristics and compensating a fluctuation in dynamic characteristics by the static compensator 5, the dynamic compensator 6, and the subtractor 7. In the middle graph, the solid line denotes an example of a relationship between a time and an electric output in no performance of the compensation for the fluctuation in the static characteristics and of the compensation for the fluctuation in the dynamic characteristics. In the middle graph, the dashed line denotes an example of a relationship between a time and an electric output in performance of the compensation for the fluctuation in the static characteristics and of the compensation for the fluctuation in the dynamic characteristics in the hydraulic excavator 20 according to the embodiment.

As shown in the middle graph in FIG. 5, in the hydraulic excavator 20 according to the embodiment, a rise of the electric output (the actual input $u_p(k)$) is modified through the compensation for the fluctuation in the dynamic characteristics. In this manner, overshooting of the rise is suppressed and a desirable rise slope is obtainable as denoted by the dashed line. In the hydraulic excavator 20 according to the embodiment, the performance of the compensation for the fluctuation in the static characteristics leads to modification of steady-state characteristics of the electric output (actual input $u_p(k)$). In this manner, a desired steady-state value is obtained as denoted by the dashed line.

The lower graph in FIG. 5 exemplifies a relationship between a time and a control output which the boom cylinder 27 in the controlled object 100 outputs. The control output of the boom cylinder 27 may include an operation speed of the boom cylinder 27 or a physical quantity corresponding to the operation speed of the boom cylinder 27 as described above. Specifically, the physical quantity may be a flow rate of the hydraulic fluid being supplied to the boom cylinder 27, a flow rate of the hydraulic fluid being discharged from the boom cylinder 27, or another physical quantity. The lower graph shows an effect of adjustment of each of the static parameter and the dynamic parameter by the parameter adjuster 9. In the lower graph, the solid line denotes an example of a relationship between a time and a control output in no performance of the adjustment of the static parameter and the dynamic parameter by the parameter adjuster 9. In the lower graph, the dashed line denotes an example of a relationship between a time and a control output in performance of the adjustment of the static parameter and the dynamic parameter by the parameter adjuster 9 in the hydraulic excavator 20 according to the embodiment.

As shown in the lower graph in FIG. 5, the parameter adjuster 9 adjusts each of the static parameter and the dynamic parameter in the hydraulic excavator 20 according to the embodiment. In this manner, even when the input and output characteristics of the controlled object 100 largely fluctuate, the input and output characteristics of the control input $u_c(k)$ and the control output y(k) are maintained to ideal input and output characteristics at the time of designing the controller 4. Hence, even when the input and output characteristics of the controlled object 100 largely fluctuate, the controlled object 100 is appropriately controllable by using the controller 4 in the initial design.

Figure 6:
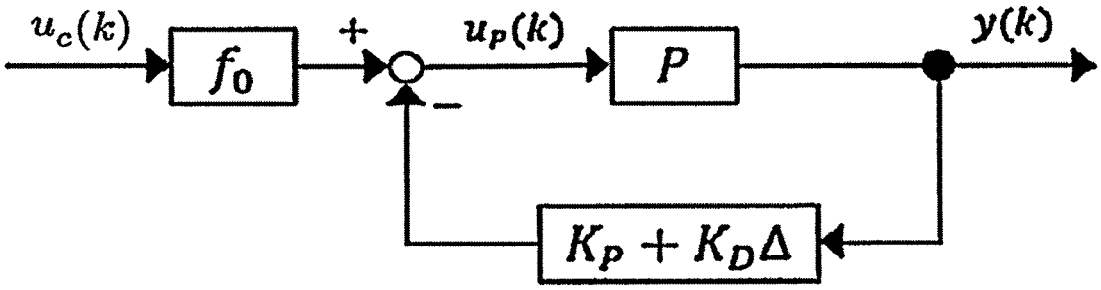
FIG. 6 is a block diagram showing a feedback system constituting a control loop.

Next, an example of the design of the control loop 50 will be described in detail. FIG. 6 is a block diagram showing a feedback system constituting the control loop 50. The feedback system is expressed by the following formula.

Formula 1

$$u_p(k)=f_0(k)u_c(k)-K_p(k)y(k)-K_D(k)\Delta y(k) \quad (1)$$

Here, the signs "$u_p(k)$", "y(k)", "$u_c(k)$", and "P" respectively denote an actual input, a control output, a control input, and a controlled object. Further, the sign "Δ" denotes a difference operator, and a backward operator $z^{-1}$ is used to express "$\Delta=1-z^{-1}$". The signs "$f_0(k)$", "$K_p(k)$", "$K_D(k)$" respectively denote parameters. The parameter adjuster 9 tunes the parameters $f_0(k)$, $K_p(k)$, $K_D(k)$ online by using the iterative least square technique. The iterative least square technique has a merit of a low calculation cost. The parameter adjuster 9 calculates a parameter of each of the static compensator 5 and the dynamic compensator 6 from operational data (including the actual input $u_p(k)$ and the control output y(k)).

Subsequently, a way of adjusting each parameter on the basis of the operational data will be described. Assuming that the equation "$f_0(k)=0$" is not satisfied, Equation (1) is changed as follows.

Formula 2

$$u_c(k) = \frac{1}{f_0(k)}u_p(k) + \frac{K_P(k)+K_D(k)}{f_0(k)}y(k) - \frac{K_D(k)}{f_0(k)}y(k-1) \quad (2)$$

$$= \theta_1(k)u_P(k) + \theta_2(k)y(k) + \theta_3(k)y(k-1) \quad (3)$$

$$\theta_1(k) = \frac{1}{f_0(k)},\ \theta_2(k) = \frac{K_P(k)+K_D(k)}{f_0(k)},\ \theta_3(k) = -\frac{K_D(k)}{f_0(k)} \quad (4)$$

In this regard, in Equation (3), parameters "$\theta_1(k)$", "$\theta_2(k)$", "$\theta_3(k)$" are expressed by Equation (4).

Moreover, a response obtainable in inputting of the control input $u_c(k)$ to the input and output model $G_m(z^{-1})$ indicating an ideal transfer function of the control loop 50 is defined as an ideal output $y_r(k, \theta(k))$. In this case, the ideal output $y_r(k, \theta(k))$ is expressed by Equation (5).

Formula 3

$$y_r(k,\theta(k))=G_m(z^{-1})u_c(k,\theta(k)) \quad (5)$$

The following Formula is obtainable from the relation between Equation (3) and Equation (5).

Formula 4

$$y_r(k,\theta(k))=\theta_1\hat{u}_p(k)+\theta_2\hat{y}(k)+\theta_3\hat{y}(k-1) \quad (6)$$

$$\hat{u}_p(k)=G_m(z^{-1})u_p(k) \quad (7)$$

$$\hat{y}(k)=G_m(z^{-1})y(k) \quad (8)$$

An evaluation function J is defined as follows.

Formula 5

$$J = \frac{1}{N}\sum_{k=1}\{y(k) - y_r(k, \theta(k))\}^2 \quad (9)$$

In this regard, the sign "N" denotes the number of data, and the parameter θ(k) is adjusted in such a manner that the control output y(k) follows the ideal output $y_r(k)$ by minimizing the evaluation function J. Use of the optimized parameter allows input and output characteristics of the control loop 50 including the static compensator 5, the dynamic compensator 6, and the controlled object 100 to agree with input and output characteristics of the input and output model $G_m(z^{-1})$.

Next, the iterative least square technique shown below is adopted to minimize the square sum in Equation (9).

Formula 6

$$\theta(k) = \theta(k-1) + K(k)\{y(k) - y_r(k, \theta(k))\} \quad (10)$$

$$K(k) = \frac{\Gamma(k-1)\psi(k)}{\omega + \psi^T(k)\Gamma(k-1)\psi(k)} \quad (11)$$

$$\Gamma(k) = \frac{1}{\omega}\left\{\Gamma(k-1) - \frac{\Gamma(k-1)\psi(k-1)\psi^T(k-1)\Gamma(k-1)}{\omega + \psi^T(k-1)\Gamma(k-1)\psi(k-1)}\right\} \quad (12)$$

The sign "ω" denotes a forgetting factor. The signs "θ(k)" and "ψ(k)" are expressed by the following formula.

Formula 7

$$\theta(k)=[\theta_1(k)\theta_2(k)\theta_3(k)]^T \quad (13)$$

$$\psi(k)=G_m(z^{-1})[u_p(k)y(k)y(k-1)]^T \quad (14)$$

An initial value Γ(0) of an error covariance matrix Γ(k) and an initial value θ(0) of an estimative value θ(k) are defined by the following formula.

Formula 8

$$\Gamma(0)=\alpha I \quad (15)$$

$$\theta(0)=[\theta_1(0)\theta_2(0)\theta_3(0)]^T \quad (16)$$

The sign "α" is a certain real number satisfying "α>0". The sign "I" denotes an identity matrix of 3×3. The sign "$\theta_i(0)$" denotes a certain real number. The real number $\theta_i(0)$ is defined as not "0" under the condition that the gain $f_0$ is not "0".

Next, an example of a configuration of each of the pump control device 14 and the valve control device 13 in the embodiment will be described in detail. As mentioned above, FIG. 3 shows each of the pump control device 14 and the valve control device 13.

The control loop 50 represents a downstream control loop formed of a control system including the static compensator 5 and the dynamic compensator 6 in combination. The controller 4 represents an upstream control loop. The controller 4 is formed of a PID (proportional-integral-derivative) control system having a fixed control parameter.

In the configuration in FIG. 3, the parameter of each of the static compensator 5 and the dynamic compensator 6 is adjusted so that the input and output characteristics of the control loop 50 agree with the input and output characteristics of the input and output model $G_m(z^{-1})$. In this manner, the downstream control loop 50 has input and output characteristics equivalent to those of the input and output model $G_m(z^{-1})$. As a result, the upstream controller 4 can be designed on the basis of the ideal input and output model $G_m(z^{-1})$.

The controller 4 in the embodiment is formed of a PID control system expressed by Equation (17).

Formula 9

$$u_C(k) = k_c\left\{\frac{1}{T_I}e(k) - \Delta y(k) - T_D\Delta^2 y(k)\right\} \quad (17)$$

$$e(k) = r(k) - y(k) \quad (18)$$

The sign "$k_c$" denotes a proportional gain, the sign "$T_I$" denotes an integral time [s], and the sign "$T_D$" denotes a derivative time [s].

Subsequently, a simulation applying each of the pump control device 14 and the valve control device 13 in the embodiment to a hydraulic motor control system will be described.

In the embodiment, the ideal input and output model $G_m(z^{-1})$ of the control loop 50 is designed as follows.

Formula 10

$$G_m(z^{-1}) = \frac{z^{-1}P(1)}{P(z^{-1})} \tag{19}$$

The denominator "$P(z^{-1})$" is expressed by the following formula. The coefficients "$p_1$", "$p_2$" are expressed by the following formula.

Formula 11

$$P(z^{-1}) = 1 + \rho 1 \cdot z^{-1} + \rho 2 \cdot z^{-2} \tag{20}$$

$$\begin{cases} p_1 & = -2\exp\left(-\frac{\rho}{2\mu}\cos\left(\frac{\sqrt{4\mu-1}}{2\mu}\rho\right)\right) \\ p_2 & = \exp\left(-\frac{\rho}{\mu}\right) \\ \rho & = \frac{T_s}{\sigma} \\ \mu & = 0.25(1-\delta) + 0.51\delta \end{cases} \tag{21}$$

The sign "$T_s$" denotes a sampling time, the signs "σ", "δ" respectively denote dynamic parameters, such as rise characteristics and damping characteristics, of the controlled object 100. A designer appropriately sets the dynamic parameters on the basis of the input and output characteristics of the controlled object 100.

Modifications

Although the hydraulic excavator 20 serving as an example of the hydraulic working machine according to the embodiment of the present invention is described heretofore, the present invention is not limited to the embodiment, and can include modifications, for example, described below.

(A) Mode Input Receiver

Figure 7:
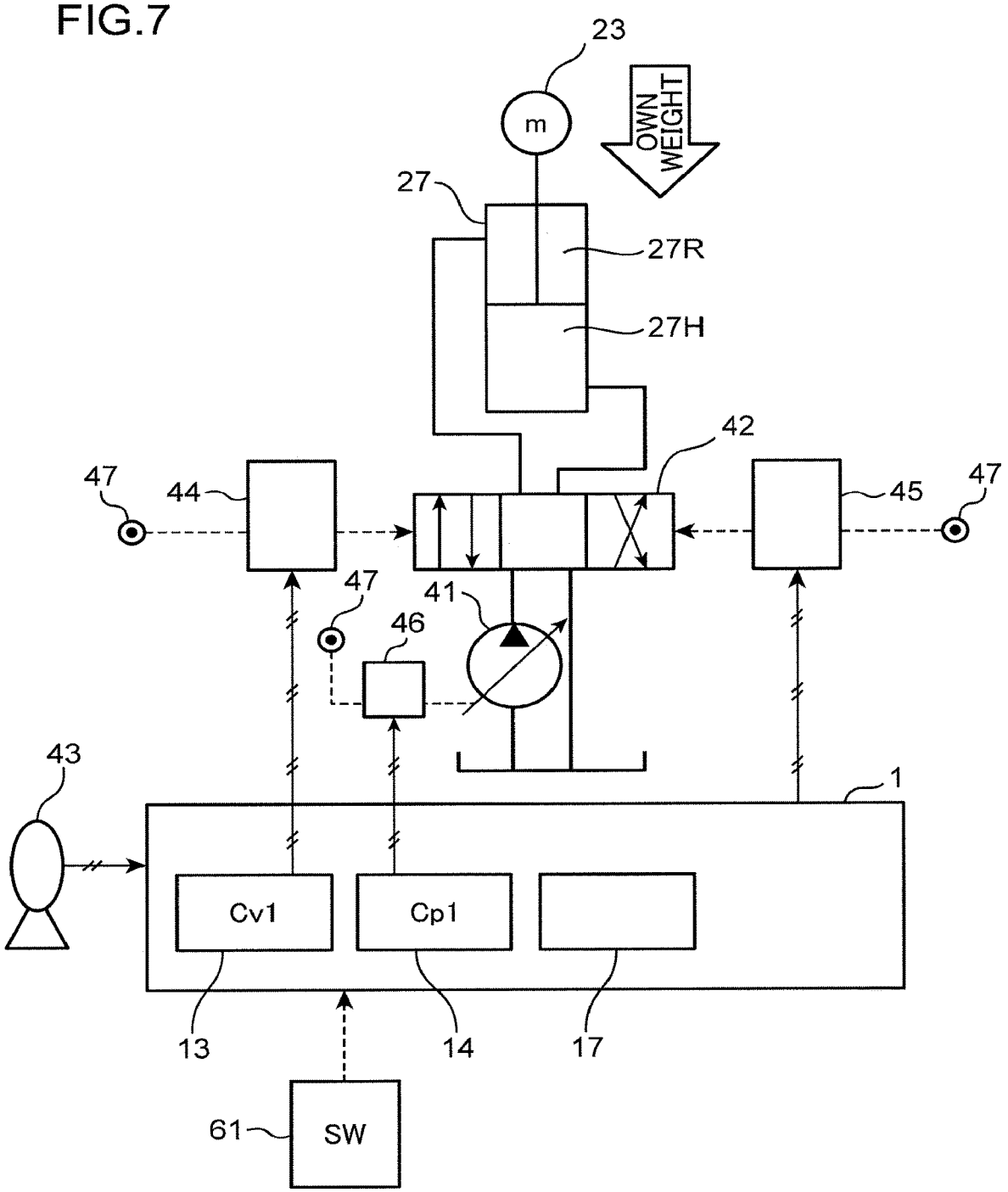
FIG. 7 is a diagram showing another example of a hydraulic circuit and a control unit in the hydraulic working machine.

FIG. 7 is a diagram showing another example of a hydraulic circuit and a control unit 1 included in the hydraulic excavator 20. In the modification shown in FIG. 7, the hydraulic excavator 20 further includes a mode input receiver 61. The mode input receiver 61 receives an input to change a control mode in the hydraulic excavator 20 between a first mode and a second mode which are preset. The input is made by a work-related person, such as an operator, a work manager, and other related person. The mode input receiver 61 may include, for example, a switch provided inside the cabin 31.

The first mode is a mode in which the parameter adjuster 9 adjusts a parameter, and the second mode is a mode in which the parameter adjuster 9 withholds the adjustment of the parameter. In the second mode, compensation for a fluctuation in static characteristics and compensation for a fluctuation in dynamic characteristics may be performed, or the compensation for each fluctuation may be withheld.

The parameter adjuster 9 in each of the pump control device 14 and the valve control device 13 withholds a control of adjusting a static parameter and a dynamic parameter when the control mode is in the second mode. By contrast, the parameter adjuster 9 in each of the pump control device 14 and the valve control device 13 executes the control of adjusting the static parameter and the dynamic parameter when the control mode is changed from the second mode to the first mode in response to an input received by the mode input receiver 61 from the work-related person.

This modification achieves a control reflecting a will of an operator. Specifically, for instance, a skilled operator can maneuver a hydraulic working machine by effectively using the skill thereof without relying on an automatic control by the hydraulic working machine, and an unskilled operator having fewer experiences can improve work efficiency by relying on the automatic control by the hydraulic working machine.

(B) Control Based on Replacement Determination and Deterioration Determination

Figure 8:
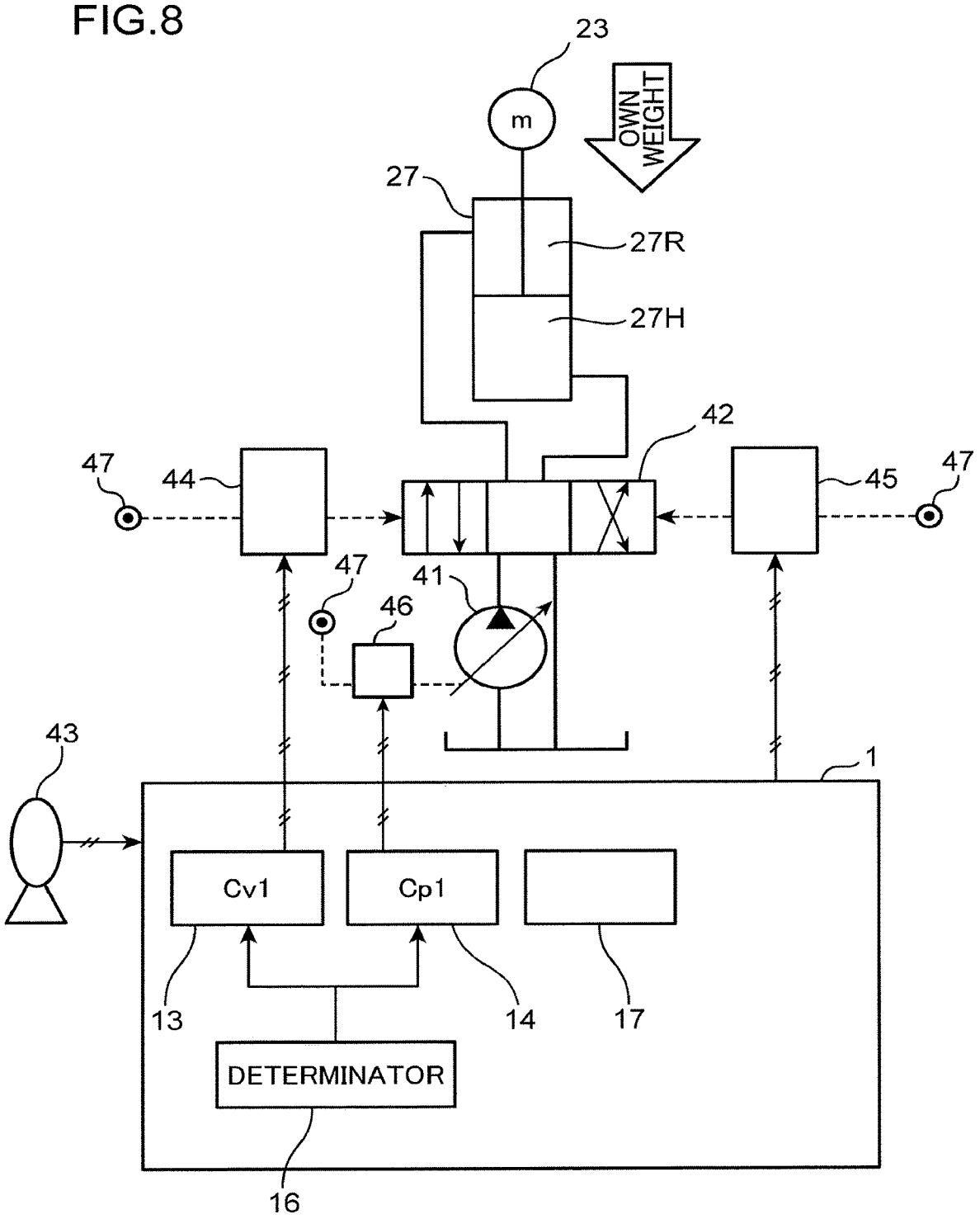
FIG. 8 is a diagram showing still another example of a hydraulic circuit and a control unit in the hydraulic working machine.

FIG. 8 is a diagram showing still another example of a hydraulic circuit and a control unit 1 included in the hydraulic excavator 20. In the modification shown in FIG. 8, the control unit 1 further includes a determinator 16. The determinator 16 may include a replacement determinator that determines replacement of at least one component of the working device 23 with another component. The determinator 16 may include a deterioration determinator that determines a deterioration of the hydraulic excavator 20. The replacement determinator determines, on the basis of a predetermined determination criterion, whether one component of the working device 23 has been replaced with another component. The deterioration determinator determines, on the basis of a predetermined determination criterion, a deterioration of the hydraulic excavator 20.

Specifically, detailed example cases of replacement of at least one component of the working device 23 with another component include a case where a leading end attachment of the working device 23 is replaced with another leading end attachment having a different weight of the same kind, and a case where the leading end attachment of the working device 23 is replaced with another leading end attachment of a different kind. Examples of the kind of leading end attachment include a grapple, a crusher (demolisher), a breaker, a fork, and other leading end attachments in addition to the bucket 26.

Figure 9:
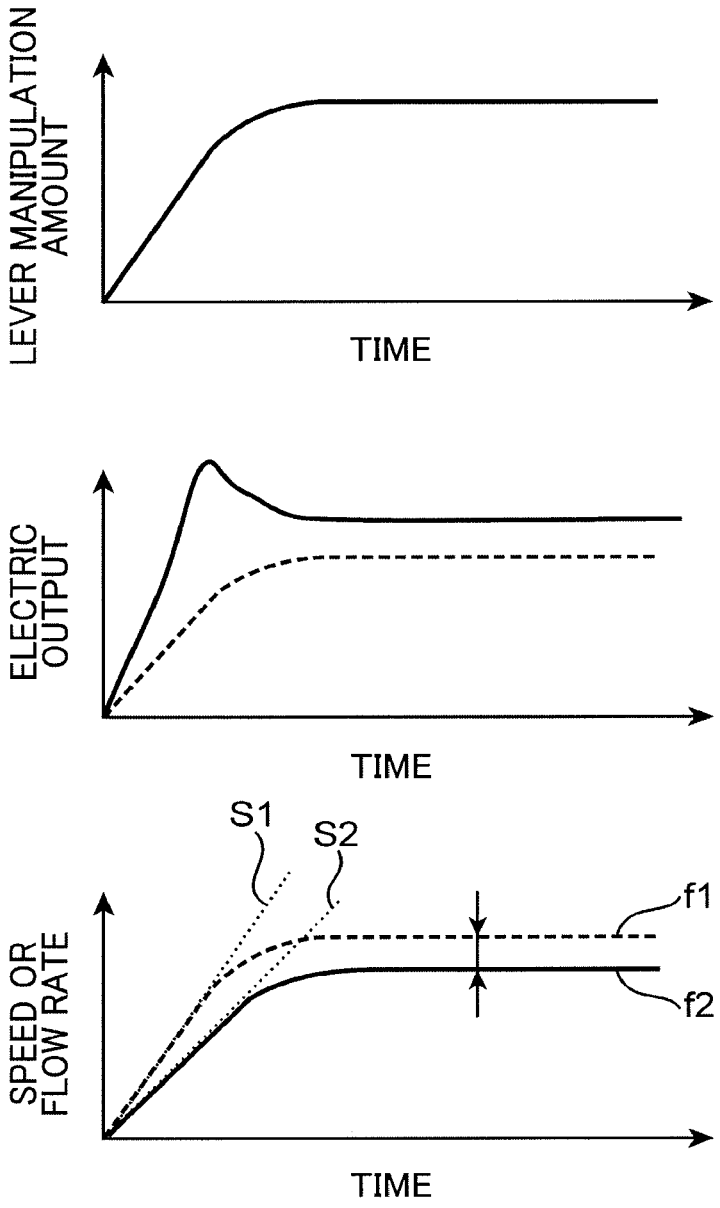
FIG. 9 includes graphs respectively showing another example of a relationship between a time and a manipulation amount of a manipulation received by a manipulation device included in the hydraulic working machine, another example of a relationship between a time and an electric output, and another example of a relationship between a time and a control output.

The upper graph in FIG. 9 exemplifies a relationship between a time and a manipulation amount (lever manipulation amount) of a boom manipulation received by the boom manipulation device 43. The middle graph in FIG. 9 exemplifies a relationship between a time and an electric output which is output from the subtractor 7 when the boom manipulation device 43 receives the boom manipulation (boom raising manipulation or boom lowering manipulation) as shown in the upper graph. The upper graph and the middle graph in FIG. 9 are the same as the upper graph and the middle graph in FIG. 5, and thus description therefor is omitted.

The lower graph in FIG. 9 exemplifies a relationship between a time and a control output which the boom cylinder 27 in the controlled object 100 outputs. In the lower graph in FIG. 9, the solid line denotes an example of a relationship between a time and a control output in no performance of the adjustment of the static parameter and the dynamic parameter by the parameter adjuster 9. In the lower graph in FIG. 9, the dashed line denotes an example of a relationship between a time and a control output in performance of the adjustment of the static parameter and the dynamic parameter by the parameter adjuster 9 in the hydraulic excavator 20 according to the embodiment.

When input and output characteristics of the controlled object 100 largely fluctuate due to replacement of at least one component of the working device 23 with another component, a slope s2 of a rise of the control output denoted by the solid line in the lower graph in FIG. 9 and a steady-state value f2 of the control output largely fluctuate respectively from a slope s1 of a rise of an ideal control output and a steady-state value f1 of the ideal control output at the time of designating the controller 4.

When the input and output characteristics of the controlled object 100 largely fluctuate due to a deterioration of the hydraulic excavator 20, the slope s2 of the rise of the control output denoted by the solid line in the lower graph in FIG. 9 and the steady-state value f2 of the control output largely fluctuate respectively from the slope s1 of the rise of the ideal control output and the steady-state value f1 of the ideal control output at the time of designating the controller 4.

In this modification, the determination criterion may include, for example, a criterion that the slope s2 of the rise of the control output deviates from the slope s1 of the rise of the ideal control output by a preset threshold "se" or larger. Alternatively, the determination criterion may include, for example, a criterion that the steady-state value f2 of the control output deviates from the steady-state value f1 of the ideal control output by a preset threshold "fe" or larger. The determinator 16 can calculate, on the basis of the control output input from the output detector 12 to the control unit 1, the slope of the rise of the control output and the steady-state value of the control output.

The parameter adjuster 9 of the pump control device 14 withholds the control of adjusting a static parameter and a dynamic parameter, when the determinator 16 (the replacement determinator) determines that at least one component of the working device 23 has not been replaced with another component, or when the determinator 16 (the deterioration determinator) determines that the hydraulic excavator 20 has not deteriorated. By contrast, the parameter adjuster 9 of the pump control device 14 executes the control of adjusting the static parameter and the dynamic parameter, when the determinator 16 (the replacement determinator) determines that the at least one component of the working device 23 has been replaced with another component, or when the determinator 16 (deterioration determinator) determines that the hydraulic excavator 20 has deteriorated.

Similarly, the parameter adjuster 9 of the valve control device 13 withholds the control of adjusting a static parameter and a dynamic parameter, when the determinator 16 (the replacement determinator) determines that at least one component of the working device 23 has not been replaced with another component, or when the determinator 16 (deterioration determinator) determines that the hydraulic excavator 20 has not deteriorated. By contrast, the parameter adjuster 9 of the valve control device 13 executes the control of adjusting the static parameter and the dynamic parameter, when the determinator 16 (the replacement determinator) determines that the at least one component of the working device 23 has been replaced with another component, or when the determinator 16 (deterioration determinator) determines that the hydraulic excavator 20 has deteriorated.

In the modification shown in FIG. 8, the parameter adjuster 9 adjusts a static parameter and a dynamic parameter. In this manner, even when the input and output characteristics of the controlled object 100 largely fluctuate due to replacement of a component or due to a deterioration of the hydraulic excavator 20, the input and output characteristics of the control input $u_c(k)$ and the control output y(k) are maintained to ideal input and output characteristics at the time of designing the controller 4. Hence, even when the input and output characteristics of the controlled object 100 largely fluctuate, the controlled object 100 is appropriately controllable by using the controller 4 in the initial design.

(C) Mode Input Receiver

Figure 10:
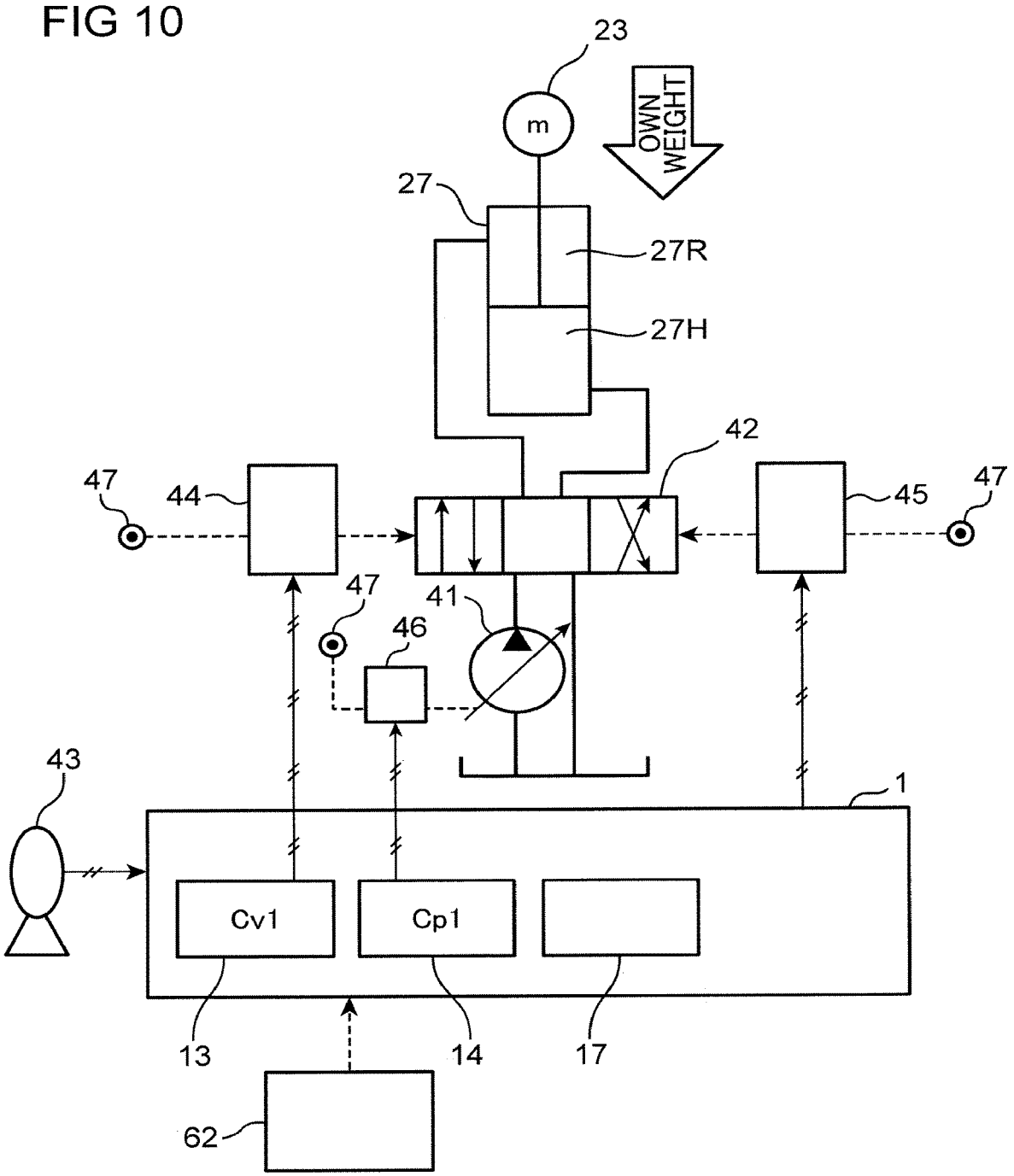
FIG. 10 is a diagram showing still another example of a hydraulic circuit and a control unit in the hydraulic working machine.
Figure 11:
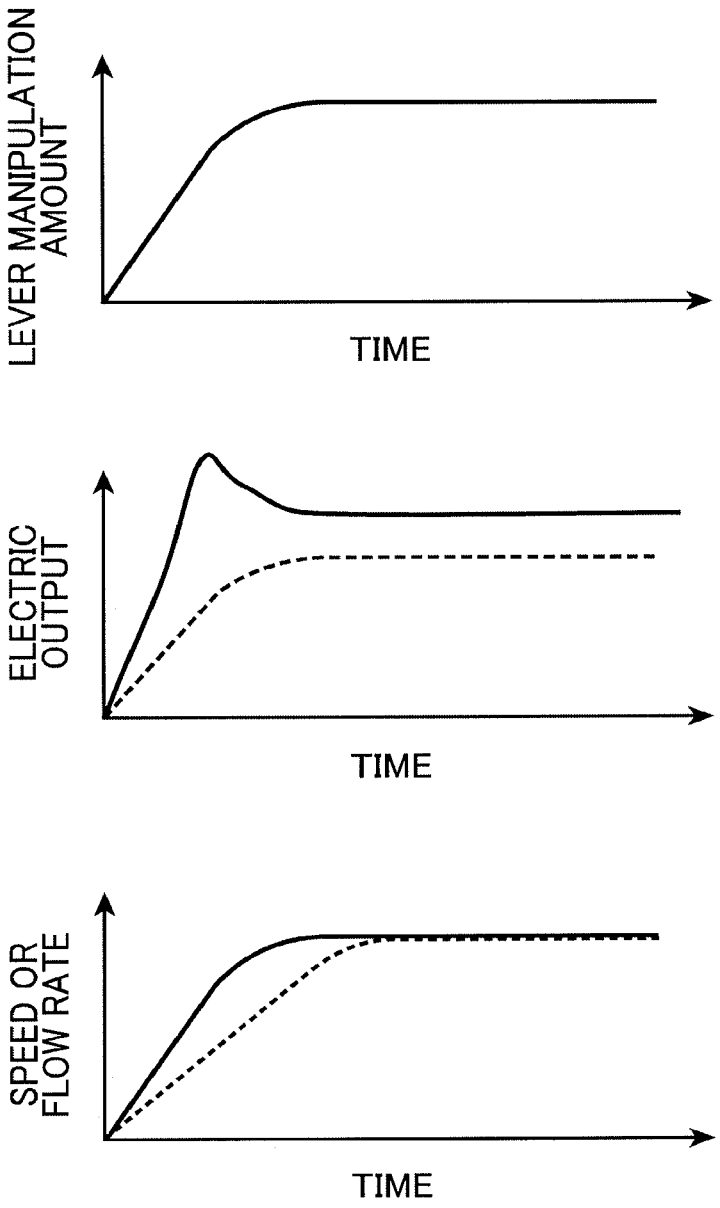
FIG. 11 includes graphs respectively showing still another example of a relationship between a time and a manipulation amount of a manipulation received by a manipulation device included in the hydraulic working machine, still another example of a relationship between a time and an electric output, and still another example of a relationship between a time and a control output.

FIG. 10 is a diagram showing still another example of a hydraulic circuit and a control unit 1 included in the hydraulic excavator 20. In the modification shown in FIG. 10, the hydraulic excavator 20 further includes a characteristics input receiver 62. The characteristics input receiver 62 receives an input to change a setting of input and output characteristics of a control input $u_c(k)$ and a control output y(k). In this modification, for instance, as shown in the lower graph in FIG. 11, a slope of a rise of a control output is changeable to a slope preferable to an operator. A work-related person, such as the operator, gives an input to change input characteristics, e.g., a desired slope of a rise, to the characteristics input receiver 62. The characteristics input receiver 62 outputs, to the control unit 1, a signal corresponding to the input. The control unit 1 changes, on the basis of the signal corresponding to the input, the setting of the input and output characteristics of the control input $u_c(k)$ and the control output y(k). Specifically, the control unit 1 changes, for example, the setting of the input and output model $G_m(z^{-1})$ in response to an input by the work-related person. In this manner, response characteristics (input and output characteristics), such as the slope of the rise of the control output, are changed to have a slope preferable to the operator.

(D) Controlled Object

A controlled object 100 to be controlled by a pump control device may include a pump proportional valve, a pump, and an arm cylinder, and a controlled object 100 to be controlled by a valve control device may include an arm proportional valve, an arm control valve, and the arm cylinder. Alternatively, the controlled object 100 to be controlled by the pump control device may include a pump proportional valve, a pump, and a bucket cylinder, and the controlled object 100 to be controlled by the valve control device may include a bucket proportional valve, a bucket control valve, and the bucket cylinder. Alternatively, the controlled object 100 to be controlled by the pump control device may include a pump proportional valve, a pump, and a slewing motor, and the controlled object 100 to be controlled by the valve control device may include a slewing proportional valve, a slewing control valve, and the slewing motor.

(E) Instruction Calculator

In the embodiment, each of the instruction calculator of the pump control device 14 and the instruction calculator of the valve control device 13 has the target setter 2, the subtractor 3, the controller 4, the static compensator 5, the dynamic compensator 6, and the subtractor 7. However, it is sufficient that an instruction calculator of a pump control device is configured to calculate a control instruction of causing a controlled object including a hydraulic pump and an actuator to operate by using a manipulation amount of a manipulation and at least one pump control parameter, and to input the control instruction to the controlled object, therefore, the instruction calculator of a pump control device is not limited to the configuration of the embodiment. It is sufficient that an instruction calculator of a valve control device is configured to calculate a control instruction of causing a controlled object including a control valve and an actuator to operate by using the manipulation amount of the manipulation and at least one valve control parameter, and to input the control instruction to the controlled object, therefore, the instruction calculator of a valve control device is not limited to the configuration of the embodiment.

(F) Parameter Adjuster

The parameter adjuster 9 may adjust a static gain $f_0$ and a dynamic gain ($K_p$, $K_D$) by using a database-driven control way. The database-driven control way includes calculating a parameter suitable for a current state of a controlled object on the basis of a parameter having been calculated in past and stored in a database.

In the case of adopting this way, each of the control devices 13, 14 further includes a database that stores a static gain $f_0$ and a dynamic gain ($K_p$, $K_D$) having been calculated in past. The parameter adjuster 9 acquires, from the memory 11, a request point indicating the current state of the controlled object 100. The request point includes, for example, control outputs y(k) and ideal outputs $y_r(k)$ in a period from a certain sample to a couple of previous samples. The parameter adjuster 9 calculates a distance between the request point and each of parameter sets stored in the database, and extracts k-parameter sets in short distance order. The parameter set includes, for example, a set of a static gain $f_0$, a proportional gain $K_p$, and a derivative gain $K_D$. The parameter adjuster 9 obtains a weight coefficient for each of the extracted k-parameter sets such that a value of the weight coefficient is larger as the distance is shorter. The parameter adjuster 9 averages the k-parameter sets by using the obtained weight coefficient, calculates a final parameter set, and defines the final parameter set as the static gain $f_0$ and the dynamic gain ($K_p$, $K_D$).

(G) Other Modifications

An arithmetic expression for use in calculating a dynamic compensatory input by the dynamic compensator 6 may include a product of a quadratic derivative term of the control output y(k) and a quadratic derivative gain. Besides, the arithmetic expression may include a value obtained by adding the product of the i-th derivative term of the control output y(k) and the i-th derivative gain from i=1 to i=n, where the sign "n" denotes a positive integer.

The hydraulic working machine may be a working machine of a hybrid type using an engine and an electric motor in combination. The working machine of the hybrid type includes, for example, a generator motor and an electric power storage device. The generator motor charges power based on electricity generated with a drive force of an engine to the electric power storage device, and causes the working machine to execute a power running operation by using the power stored in the electric power storage device to assist the engine.

As described heretofore, the present invention provides a hydraulic working machine that allows each of a power running operation and a non-power running operation to approximate to an ideal operation suited to a manipulation amount even in a case of a large fluctuation in input and output characteristics of a controlled object.

A hydraulic working machine according to one aspect of the present invention includes: a support body; a movable part that is shiftable relative to the support body; a hydraulic pump that discharges hydraulic fluid; an actuator that receives a supply of the hydraulic fluid to cause the movable part to operate; a control valve that is located between the hydraulic pump and the actuator, and opens and closes to change a flow rate of the hydraulic fluid to be supplied to the actuator; a manipulation device that receives a manipulation for an operation of the movable part; an operation determinator that determines whether the operation of the movable part performed in response to the manipulation received by the manipulation device is a power running operation of the movable part to operate against a load acting on the movable part or a non-power running operation of the movable part to operate in a direction of the load acting on the movable part; a pump control device that regulates a discharge rate of the hydraulic pump; a valve control device that regulates an opening degree of the control valve; and an output detector that detects a control output being an output of the actuator. The pump control device has: a pump instruction calculator that calculates, by using a manipulation amount of the manipulation and at least one pump control parameter, a control instruction of causing a controlled object including the hydraulic pump and the actuator to operate, and inputs the calculated control instruction to the controlled object; a pump control ideal output calculator that calculates an ideal output of the actuator, the ideal output being associated with the manipulation amount of the manipulation; and a pump control parameter adjuster that adjusts the at least one pump control parameter to reduce a difference between the control output and the ideal output when the operation of the movable part is the power running operation. The valve control device has: a valve instruction calculator that calculates, by using the manipulation amount of the manipulation and at least one valve control parameter, a control instruction of causing a controlled object including the control valve and the actuator to operate, and inputs the calculated control instruction to the controlled object; a valve control ideal output calculator that calculates an ideal output of the actuator, the ideal output being associated with the manipulation amount of the manipulation; and a valve control parameter adjuster that adjusts the at least one valve control parameter to reduce a difference between the control output and the ideal output when the operation of the movable part is the non-power running operation.

In the hydraulic working machine, a pump control parameter for calculating a control instruction to a controlled object in a power running operation is adjusted to reduce a difference between a control output and an ideal output, and a valve control parameter for calculating a control instruction to a controlled object in a non-power running operation is adjusted to reduce a difference between a control output and an ideal output. The hydraulic working machine consequently allows each of the power running operation and the non-power running operation to approximate to a corresponding ideal operation suited to a manipulation amount even in a case of a large fluctuation in input and output characteristics of each controlled object, despite a requirement of a positive drive force by a hydraulic pump for the power running operation and a requirement of a flow rate regulation by a control valve for the non-power running operation.

In the hydraulic working machine, it is preferable that the movable part includes a boom tiltably supported on the support body, the power running operation includes a boom rising operation being an operation of the boom that a distal end of the boom rises away from ground, and the non-power running operation includes a boom lowering operation being an operation of the boom that the distal end of the boom approaches the ground, and it is preferable that the operation determinator determines that the operation of the movable part is the power running operation when the manipulation device receives a boom raising manipulation being a manipulation for causing the boom to perform the boom rising operation, and determines that the operation of the movable part is the non-power running operation when the manipulation device receives a boom lowering manipulation being a manipulation for causing the boom to perform the boom lowering operation. This configuration achieves, by adjusting each of the pump control parameter and the valve control parameter, more appropriate adjustment of the drive force for the boom rising operation against the own weight of the working device including the boom and a more appropriate regulation of the flow rate of the hydraulic fluid for the boom lowering operation in a direction of the own weight of the working device including the boom.

In the hydraulic working machine, it is preferable that the control output of the actuator includes an operation speed of the actuator or a physical quantity corresponding to the operation speed, and that the output detector includes a sensor for detecting the operation speed or the physical quantity. This configuration enables the output detector of the hydraulic working machine to detect, as a reference control output for adjusting a parameter, the operation speed of the actuator or a physical quantity corresponding to the operation speed.

The hydraulic working machine may further include a mode input receiver that receives an input to change a control mode in the hydraulic working machine between a first mode and a second mode which are preset. The pump control parameter adjuster may execute a control of adjusting the at least one pump control parameter when the control mode is in the first mode, and withhold the control of adjusting the at least one pump control parameter when the control mode is in the second mode. The valve control parameter adjuster may execute a control of adjusting the at least one valve control parameter when the control mode is in the first mode, and withhold the control of adjusting the at least one valve control parameter when the control mode is in the second mode. In this configuration, a work-related person, such as an operator or a work manager, can cause the pump control device and the valve control device to execute the control of adjusting a corresponding parameter at an appropriate time when the work-related person determines necessity of the adjustment. This configuration achieves a control reflecting a will of the operator.

The hydraulic working machine preferably further includes: a working device including the movable part; and a replacement determinator that determines whether at least one component of the working device has been replaced with another component. The pump control parameter adjuster preferably executes the control of adjusting the at least one pump control parameter when the replacement determinator determines that the at least one component of the working device has been replaced with the another component. The valve control parameter adjuster preferably executes the control of adjusting the at least one valve control parameter when the replacement determinator determines that the at least one component of the working device has been replaced with the another component. In this configuration, when the replacement determinator determines that a part of the components or all the components of the working device has been replaced, each of the pump control device and the valve control device adjusts the corresponding control parameter. This configuration enables an automatic control of adjusting the control parameter in high demand for the adjustment of the control parameter while suppressing a load of a computation control.

The hydraulic working machine preferably further includes a deterioration determinator that determines, on the basis of a predetermined determination criterion, a deterioration of the hydraulic working machine. It is further preferable that the pump control parameter adjuster executes the control of adjusting the at least one pump control parameter when the deterioration determinator determines that the hydraulic working machine has deteriorated, and the valve control parameter adjuster executes the control of adjusting the at least one valve control parameter when the deterioration determinator determines that the hydraulic working machine has deteriorated. In this configuration, when the deterioration determinator determines that the hydraulic working machine has deteriorated, each of the pump control device and the valve control device adjusts the corresponding control parameter. This configuration enables an automatic control of adjusting the control parameter in high demand for the adjustment of the control parameter while suppressing a load of a computation control.

In the hydraulic working machine, the pump instruction calculator may calculate a control instruction of causing a controlled object including the hydraulic pump and the actuator to operate by using a manipulation amount of the manipulation and at least one pump control parameter. A specific configuration is not particularly limited, but it is preferable to include, for example, the configuration described below. Specifically, it is preferable that the pump instruction calculator further has: a target setter that sets a target output in accordance with the manipulation amount of the manipulation, the target output serving as a target of the control output; and a control input calculator that calculates a control input to eliminate an error between the target output and the control output, and the pump control device further has a control input compensator that calculates the control instruction by modifying the control input so as to compensate a fluctuation in characteristics of the controlled object on the basis of at least one of the control input and the control output, and on the basis of the at least one pump control parameter, and inputs the calculated control instruction to the controlled object. This configuration allows a power running operation to more accurately approximate to an ideal operation suited to a manipulation amount even in a case of a large fluctuation in input and output characteristics of the controlled object.

In the hydraulic working machine, it is preferable that the at least one pump control parameter includes a static parameter and a dynamic parameter, and the control input compensator of the pump control device includes: a static compensator that calculates, on the basis of the static parameter and the control input, a static compensatory input of compensating a fluctuation in static characteristics of the controlled object; a dynamic compensator that calculates, on the basis of the dynamic parameter and the control output, a dynamic compensatory input of compensating a fluctuation in dynamic characteristics of the controlled object; and a synthesizer that calculates the control instruction by synthesizing the static compensatory input and the dynamic compensatory input, and inputs the calculated control instruction to the controlled object. In this configuration, the control input is modified by the dynamic compensatory input calculated on the basis of the dynamic parameter and the control output, and thus, a fluctuation in the dynamic characteristics of the controlled object, such as rise characteristics and damping characteristics, can be compensated. In addition, the control input is modified by the static compensatory input calculated on the basis of the control input and the static parameter, and thus, a fluctuation in the static characteristics of the controlled object, such as a fluctuation in a scale of the control input accompanied by synthetization with the dynamic compensatory input, can be compensated.

In the hydraulic working machine, the pump control ideal output calculator preferably calculates the ideal output corresponding to the control input by using an input and output model defining an ideal input and output relationship between the control input and the control output. This configuration adjusts the static parameter and the dynamic parameter by using the ideal output and the control output each calculated during the operation of the controlled object. Thus, an online adjustment of adjusting the static parameter and the dynamic parameter is attainable during the operation of the device including the controlled object without stopping the operation.

In the hydraulic working machine, it is sufficient that the valve instruction calculator is configured to calculate a control instruction of causing a controlled object including the control valve and the actuator to operate by using the manipulation amount of the manipulation and at least one valve control parameter, therefore, a specific configuration is not particularly limited, but it is preferable to include, for example, a configuration described below. Specifically, the valve instruction calculator preferably further has: a target setter that sets a target output in accordance with the manipulation amount of the manipulation, the target output serving as a target of the control output; and a control input calculator that calculates a control input to eliminate an error between the target output and the control output. The valve control device preferably further has a control input compensator that calculates the control instruction by modifying the control input so as to compensate a fluctuation in characteristics of the controlled object on the basis of at least one of the control input and the control output, and on the basis of the at least one valve control parameter, and inputs the calculated control instruction to the controlled object. This configuration allows a non-power running operation to more accurately approximate to an ideal operation suited to a manipulation amount even in a case of a large fluctuation in input and output characteristics of the controlled object.

In the hydraulic working machine, it is preferable that the at least one valve control parameter includes a static parameter and a dynamic parameter, and that the control input compensator of the valve control device further includes: a static compensator that calculates, on the basis of the static parameter and the control input, a static compensatory input of compensating a fluctuation in static characteristics of the controlled object; a dynamic compensator that calculates, on the basis of the dynamic parameter and the control output, a dynamic compensatory input of compensating a fluctuation in dynamic characteristics of the controlled object; and a synthesizer that calculates the control instruction by synthesizing the static compensatory input and the dynamic compensatory input, and inputs the calculated control instruction to the controlled object. In this configuration, the control input is modified by the dynamic compensatory input calculated on the basis of the dynamic parameter and the control output, and thus, a fluctuation in the dynamic characteristics of the controlled object, such as rise characteristics and damping characteristics, can be compensated. In addition, the control input is modified by the static compensatory input calculated on the basis of the control input and the static parameter, and thus, a fluctuation in the static characteristics of the controlled object, such as a fluctuation in a scale of the control input accompanied by synthetization with the dynamic compensatory input, can be compensated.

In the hydraulic working machine, the valve control ideal output calculator preferably calculates the ideal output corresponding to the control input by using an input and output model defining an ideal input and output relationship between the control input and the control output. This configuration adjusts the static parameter and the dynamic parameter by using the ideal output and the control output each calculated during the operation of the controlled object. Thus, an online adjustment of adjusting the static parameter and the dynamic parameter is attainable during the operation of the device including the controlled object without stopping the operation.

The hydraulic working machine preferably further includes a characteristics input receiver that receives an input to change a setting of input and output characteristics of the control input and the control output. This configuration enables setting of input and output characteristics of a control input and a control output in the control device through inputting of characteristics preferable to an operator.

The invention claimed is:

1. A hydraulic working machine comprising:

a support body;

a movable part that is shiftable relative to the support body;

a hydraulic pump that discharges hydraulic fluid;

an actuator that receives a supply of the hydraulic fluid to cause the movable part to operate;

a control valve that is located between the hydraulic pump and the actuator, and opens and closes to change a flow rate of the hydraulic fluid to be supplied to the actuator;

a manipulation device that receives a manipulation for an operation of the movable part;

an operation determinator that determines whether the operation of the movable part performed in response to the manipulation received by the manipulation device is a power running operation of the movable part to operate against a load acting on the movable part or a non-power running operation of the movable part to operate in a direction of the load acting on the movable part;

a pump control device that regulates a discharge rate of the hydraulic pump;

a valve control device that regulates an opening degree of the control valve; and an output detector that detects a control output being an output of the actuator, wherein the pump control device has:

a pump instruction calculator that calculates, by using a manipulation amount of the manipulation and at least one pump control parameter, a control instruction of causing a controlled object to operate, the controlled object including a proportional valve that controls the hydraulic pump, and inputs the calculated control instruction to the controlled object;

a pump control ideal output calculator that calculates an ideal output of the actuator, the ideal output being associated with the manipulation amount of the manipulation; and a pump control parameter adjuster that adjusts the at least one pump control parameter to reduce a difference between the control output and the ideal output when the operation of the movable part is the power running operation, and the valve control device has:

a valve instruction calculator that calculates, by using the manipulation amount of the manipulation and at least one valve control parameter, a control instruction of causing a controlled object to operate, the controlled object including a proportional valve that controls the control valve, and inputs the calculated control instruction to the controlled object when the operation of the movable part is the non-power running operation;

a valve control ideal output calculator that calculates an ideal output of the actuator, the ideal output being associated with the manipulation amount of the manipulation; and a valve control parameter adjuster that adjusts the at least one valve control parameter to reduce a difference between the control output and the ideal output when the operation of the movable part is the non-power running operation.

2. The hydraulic working machine according to claim 1, wherein the movable part includes a boom tiltably supported on the support body, the power running operation includes a boom rising operation being an operation of the boom that a distal end of the boom rises away from ground, and the non-power running operation includes a boom lowering operation being an operation of the boom that the distal end of the boom approaches the ground, and the operation determinator determines the operation of the movable part as the power running operation when the manipulation device receives a boom raising manipulation being a manipulation for causing the boom to perform the boom rising operation, and determines the operation of the movable part as the non-power running operation when the manipulation device receives a boom lowering manipulation being a manipulation for causing the boom to perform the boom lowering operation.

3. The hydraulic working machine according to claim 1, wherein the control output of the actuator includes an operation speed of the actuator or a physical quantity corresponding to the operation speed, and the output detector includes a sensor for detecting the operation speed or the physical quantity.

4. The hydraulic working machine according to claim 1, further comprising a mode input receiver that receives an input to change a control mode in the hydraulic working machine between a first mode and a second mode which are preset, wherein the pump control parameter adjuster executes a control of adjusting the at least one pump control parameter when the control mode is in the first mode, and withholds the control of adjusting the at least one pump control parameter when the control mode is in the second mode, and the valve control parameter adjuster executes a control of adjusting the at least one valve control parameter when the control mode is in the first mode, and withholds the control of adjusting the at least one valve control parameter when the control mode is in the second mode.

5. The hydraulic working machine according to claim 1, further comprising:

a working device including the movable part; and a replacement determinator that determines whether at least one component of the working device has been replaced with another component, wherein the pump control parameter adjuster executes the control of adjusting the at least one pump control parameter when the replacement determinator determines that the at least one component of the working device has been replaced with the another component, and the valve control parameter adjuster executes the control of adjusting the at least one valve control parameter when the replacement determinator determines that the at least one component of the working device has been replaced with the another component.

6. The hydraulic working machine according to claim 1, further comprising a deterioration determinator that determines, on the basis of a predetermined determination criterion, a deterioration of the hydraulic working machine, wherein the pump control parameter adjuster executes the control of adjusting the at least one pump control parameter when the deterioration determinator determines that the hydraulic working machine has deteriorated, and the valve control parameter adjuster executes the control of adjusting the at least one valve control parameter when the deterioration determinator determines that the hydraulic working machine has deteriorated.

7. The hydraulic working machine according to claim 1, wherein the pump instruction calculator further has:

a target setter that sets a target output in accordance with the manipulation amount of the manipulation, the target output serving as a target of the control output; and a control input calculator that calculates a control input to eliminate an error between the target output and the control output, and the pump control device further has a control input compensator that calculates the control instruction by modifying the control input so as to compensate a fluctuation in characteristics of the controlled object on the basis of at least one of the control input and the control output, and on the basis of the at least one pump control parameter, and inputs the calculated control instruction to the controlled object.

8. The hydraulic working machine according to claim 7, wherein the at least one pump control parameter includes a static parameter and a dynamic parameter, and the control input compensator of the pump control device includes:

a static compensator that calculates, on the basis of the static parameter and the control input, a static compensatory input of compensating a fluctuation in static characteristics of the characteristics of the controlled object;

a dynamic compensator that calculates, on the basis of the dynamic parameter and the control output, a dynamic compensatory input of compensating a fluctuation in dynamic characteristics of the characteristics of the controlled object; and a synthesizer that calculates the control instruction by synthesizing the static compensatory input and the dynamic compensatory input, and inputs the calculated control instruction to the controlled object.

9. The hydraulic working machine according to claim 7, wherein the pump control ideal output calculator calculates the ideal output corresponding to the control input by using an input and output model defining an ideal input and output relationship between the control input and the control output.

10. The hydraulic working machine according to claim 9, further comprising a characteristics input receiver that receives an input to change a setting of input and output characteristics of the control input and the control output.

11. The hydraulic working machine according to claim 1, wherein the valve instruction calculator has:

a target setter that sets a target output in accordance with the manipulation amount of the manipulation, the target output serving as a target of the control output; and a control input calculator that calculates a control input to eliminate an error between the target output and the control output, and the valve control device further has a control input compensator that calculates the control instruction by modifying the control input so as to compensate a fluctuation in characteristics of the controlled object on the basis of at least one of the control input and the control output, and on the basis of the at least one valve control parameter, and inputs the calculated control instruction to the controlled object.

12. The hydraulic working machine according to claim 11, wherein the at least one valve control parameter includes a static parameter and a dynamic parameter, and the control input compensator of the valve control device includes:

a static compensator that calculates, on the basis of the static parameter and the control input, a static compensatory input of compensating a fluctuation in static characteristics of the characteristics of the controlled object;

a dynamic compensator that calculates, on the basis of the dynamic parameter and the control output, a dynamic compensatory input of compensating a fluctuation in dynamic characteristics of the characteristics of the controlled object; and a synthesizer that calculates the control instruction by synthesizing the static compensatory input and the dynamic compensatory input, and inputs the calculated control instruction to the controlled object.

13. The hydraulic working machine according to claim 11, wherein the valve control ideal output calculator calculates the ideal output corresponding to the control input by using an input and output model defining an ideal input and output relationship between the control input and the control output.

* * * * *